US010894639B2

(12) United States Patent
Pruiett

(10) Patent No.: US 10,894,639 B2
(45) **Date of Patent: *Jan. 19, 2021**

(54) CONTAINER AND CAP ASSEMBLY

(71) Applicant: BISSELL Inc., Grand Rapids, MI (US)

(72) Inventor: Jason W. Pruiett, Grand Rapids, MI (US)

(73) Assignee: BISSELL INC., Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/871,291

(22) Filed: May 11, 2020

(65) Prior Publication Data

US 2020/0270032 A1 Aug. 27, 2020

Related U.S. Application Data

(63) Continuation of application No. 16/232,537, filed on Dec. 26, 2018, now Pat. No. 10,647,481, which is a continuation of application No. 14/212,179, filed on Mar. 14, 2014, now Pat. No. 10,189,614.

(60) Provisional application No. 61/792,238, filed on Mar. 15, 2013, provisional application No. 61/826,300, filed on May 22, 2013.

(51) Int. Cl.

| | |
|---|---|
| ***B65D 47/32*** | (2006.01) |
| ***B65D 47/20*** | (2006.01) |
| ***A47L 11/40*** | (2006.01) |

(52) U.S. Cl.

CPC ..... *B65D 47/32* (2013.01); *A47L 11/4083* (2013.01); *B65D 47/2031* (2013.01)

(58) Field of Classification Search

CPC ..... A47L 11/4088; A47L 11/34; B05B 7/24; B05B 9/0403; B05B 9/043; B65D 83/00; B65D 47/06; B65D 83/14; B67D 7/02

USPC ..... 220/203.01

See application file for complete search history.

(56) References Cited

U.S. PATENT DOCUMENTS

| | | | |
|---|---|---|---|
| 236,478 | A | 1/1881 | Ball et al. |
| 3,923,183 | A | 12/1975 | Choksi et al. |
| 4,062,466 | A | 12/1977 | Conti |
| 4,103,803 | A | 8/1978 | Irvine |
| 4,190,169 | A | 2/1980 | Pehr |
| 4,408,701 | A | 10/1983 | Jeans |

(Continued)

FOREIGN PATENT DOCUMENTS

| | | | |
|---|---|---|---|
| EP | 0268451 | A2 | 11/1988 |
| GB | 2259653 | a | 3/1993 |

(Continued)

OTHER PUBLICATIONS

Michael Bate, Examiner, Search Report under Section 17(5), 3 pages, dated Aug. 7, 2014, South Wales.

(Continued)

*Primary Examiner* — Timothy L Maust
*Assistant Examiner* — James R Hakomaki
(74) *Attorney, Agent, or Firm* — McGarry Bair PC

(57) ABSTRACT

A fluid delivery system for selectively dispensing a material includes a container with a top wall in which an opening is formed, a bottom wall, and at least one container side wall extending between the top wall and the bottom wall defining a cavity for storing the material, as well as a surface cleaning apparatus including a receiver configured to couple with the container. The receiver includes at least one receiver fluid inlet, at least one receiver fluid outlet and a locking mechanism.

20 Claims, 13 Drawing Sheets

(56) References Cited

U.S. PATENT DOCUMENTS

| | | | |
|---|---|---|---|
| 4,411,369 | A | 10/1983 | Borows |
| 4,558,484 | A | 12/1985 | Groth |
| 4,567,993 | A | 2/1986 | Albrecht et al. |
| 4,676,287 | A | 6/1987 | Fitzwater |
| 4,726,494 | A | 2/1988 | Scott |
| 5,102,010 | A | 4/1992 | Osgar et al. |
| 5,205,440 | A | 4/1993 | Matsushita |
| 5,299,608 | A | 4/1994 | Bosyj |
| 5,330,154 | A | 7/1994 | Mashburn et al. |
| 5,425,404 | A | 6/1995 | Dyer |
| 5,526,853 | A | 6/1996 | McPhee et al. |
| 5,549,228 | A | 8/1996 | Brown |
| 5,573,046 | A | 11/1996 | Venooker et al. |
| 5,586,590 | A | 12/1996 | Venooker et al. |
| 5,697,115 | A | 12/1997 | Sciarra et al. |
| 5,842,682 | A | 12/1998 | Schennum et al. |
| 5,862,948 | A | 1/1999 | Duchon et al. |
| 5,884,679 | A | 3/1999 | Hansen et al. |
| 5,924,606 | A | 7/1999 | Huizing |
| 5,947,171 | A | 9/1999 | Woodruff |
| 5,971,179 | A | 10/1999 | Christmas et al. |
| 5,975,164 | A | 11/1999 | Whaley et al. |
| 6,012,596 | A | 1/2000 | Oglesbee et al. |
| 6,014,970 | A | 1/2000 | Ivri et al. |
| 6,081,962 | A | 7/2000 | Kasen |
| 6,082,586 | A | 7/2000 | Banks |
| 6,092,569 | A | 7/2000 | Simmel et al. |
| 6,142,750 | A | 11/2000 | Benecke |
| 6,158,486 | A | 12/2000 | Olson et al. |
| 6,167,586 | B1 | 1/2001 | Reed, Jr. et al. |
| 6,170,543 | B1 | 1/2001 | Simmel et al. |
| 6,179,167 | B1 | 1/2001 | Boot et al. |
| 6,223,791 | B1 | 5/2001 | Arsenault et al. |
| 6,269,837 | B1 | 8/2001 | Arent et al. |
| 6,283,330 | B1 | 9/2001 | Gillespie et al. |
| 6,321,941 | B1 | 11/2001 | Argentieri et al. |
| 6,325,115 | B1 | 12/2001 | Cowland et al. |
| 6,354,346 | B2 | 3/2002 | Arsenault et al. |
| 6,363,235 | B1 | 3/2002 | Chiesa et al. |
| 6,386,392 | B1 | 5/2002 | Argentieri et al. |
| 6,390,335 | B1 | 5/2002 | Lawson et al. |
| 6,427,730 | B2 | 8/2002 | Nagel et al. |
| 6,450,214 | B1 | 9/2002 | Dyer et al. |
| 6,488,058 | B1 | 12/2002 | Dyer et al. |
| 6,543,496 | B2 | 4/2003 | Woodruff |
| 6,601,734 | B1 | 8/2003 | Smith |
| 6,612,344 | B2 | 9/2003 | Nagel et al. |
| 6,685,056 | B1 | 2/2004 | Argentieri et al. |
| 6,688,499 | B2 | 2/2004 | Zhang |
| 6,735,811 | B2 | 5/2004 | Field et al. |
| 6,758,372 | B2 | 7/2004 | Studer et al. |
| 6,771,925 | B2 | 8/2004 | Satoh |
| 6,893,180 | B2 | 5/2005 | Hall et al. |
| 6,923,345 | B1 | 8/2005 | Laible |
| 6,951,295 | B1 | 10/2005 | Gaus et al. |
| 6,971,549 | B2 | 12/2005 | Leifheit et al. |
| 6,973,945 | B2 | 12/2005 | Haimi |
| 7,051,399 | B2 | 5/2006 | Field et al. |
| 7,121,437 | B2 | 10/2006 | Kasting |
| 7,140,519 | B1 | 11/2006 | Kiser |
| 7,156,324 | B2 | 1/2007 | Birrenkott et al. |
| 7,165,568 | B2 | 1/2007 | Kessell et al. |
| 7,178,743 | B2 | 2/2007 | Clarke, III et al. |
| 7,246,724 | B2 | 7/2007 | Dave |
| 7,305,986 | B1 | 12/2007 | Steiner et al. |
| 7,364,702 | B2 | 4/2008 | Hoffman et al. |
| 7,407,117 | B2 | 8/2008 | Dodd |
| 7,533,439 | B2 | 5/2009 | Theiss, Jr. et al. |
| 7,544,289 | B2 | 6/2009 | Straka et al. |
| 7,607,591 | B2 | 10/2009 | Barch et al. |
| 7,621,426 | B2 | 11/2009 | Reynolds et al. |
| 7,770,758 | B2 | 8/2010 | Le Manor |
| 7,780,043 | B2 | 8/2010 | Jourdin et al. |
| 7,784,311 | B2 | 8/2010 | Santoemma et al. |
| 7,819,381 | B2 | 10/2010 | Abe |
| 7,823,756 | B2 | 11/2010 | Alley |
| 7,832,593 | B2 | 11/2010 | Raterman et al. |
| 7,837,132 | B2 | 11/2010 | Mazooji et al. |
| 7,841,491 | B2 | 11/2010 | Contiero |
| 7,849,872 | B2 | 12/2010 | Philips et al. |
| 7,854,354 | B2 | 12/2010 | Laible |
| 7,980,421 | B2 | 7/2011 | Ophardt et al. |
| 8,020,733 | B2 | 9/2011 | Snodgrass |
| 2002/0121531 | A1 | 9/2002 | Stillinger et al. |
| 2004/0195245 | A1 | 10/2004 | Gohil |
| 2005/0000053 | A1 | 1/2005 | Kasper et al. |
| 2005/0040131 | A1 | 2/2005 | Lin |
| 2011/0107545 | A1 | 5/2011 | Cagnina et al. |
| 2011/0186535 | A1 | 8/2011 | Meager |
| 2012/0193318 | A1 | 8/2012 | Meager |

FOREIGN PATENT DOCUMENTS

| | | | |
|---|---|---|---|
| WO | 1985003853 | A1 | 9/1985 |
| WO | 2009136781 | A1 | 11/2009 |
| WO | 2012025425 | A1 | 3/2012 |

OTHER PUBLICATIONS

Patent Directorate, Examination Report under Section 18(3), dated May 7, 2015, 5 pages, South Wales.

Dr. Peter Aspinall, Patents Act 1977: Combined Search and Examination Report Under Sections 17 and 18(4), dated Feb. 4, 2016, 4 pages, South Wales.

CONTAINER AND CAP ASSEMBLY

CROSS-REFERENCE TO RELATED APPLICATIONS

This application is a continuation of U.S. patent application Ser. No. 16/232,537, filed Dec. 26, 2018, now U.S. Pat. No. 10,647,481, issued on May 12, 2020, which is a continuation of U.S. patent application Ser. No. 14/212,179, filed Mar. 14, 2014, now U.S. Pat. No. 10,189,614, issued on Jan. 29, 2019, which claims the benefit of U.S. Provisional Patent Application No. 61/792,238, filed Mar. 15, 2013 and U.S. Provisional Patent Application No. 61/826,300, filed May 22, 2013, all of which are incorporated herein by reference in their entirety.

BACKGROUND

Aspects of the disclosure generally relate to dispensing a treating chemistry onto household surfaces. Soft surfaces, such as carpets, rugs, and upholstery, and hard surfaces, such as bare flooring, tile, hardwood, laminate and vinyl, can become soiled by debris or other materials during use. Some surface cleaning devices, such as a vacuum cleaner, use suction to remove debris and other soiling material from the surface, while others, such as a mop, use an absorbent or attractive material collect debris and soiling material from the surface. In some instances, it may be desirable to use a treating chemistry to facilitate removal of debris and soiling material from the surface. Some surface cleaning devices include a fluid dispensing system capable of dispensing a treating chemistry to the surface to facilitate cleaning the surface.

For example, fluid dispensing systems in extraction cleaners can include a tank that can be filled with water or other treating chemistry solution that can be dispensed to the surface during use. Typically, the tank can be integrated with the extraction cleaner such that it is not removed from the cleaner during filling or the tank can be removable such that it can be removed, filled with a treating chemistry solution, and replaced within the extraction cleaner. Alternatively, some devices, such as bare floor cleaners for example, include a fluid dispensing system which is configured to receive a disposable or one time use container which stores a supply of treating. The container couples directly to the fluid dispensing system of the cleaner to provide the treating chemistry and then is disposed of and replaced with a new container when the supply of treating chemistry is exhausted.

BRIEF DESCRIPTION

In one aspect, the disclosure relates to a container having a top wall in which an opening is formed, a bottom wall, and at least one container side wall extending between the top wall and the bottom wall defining a cavity for storing a material and a cap received on the container to close the opening and including an end face having at least one fluid outlet and at least one fluid inlet, and a side wall extending from the end face wherein the cap is separable along the side wall to separate a first portion of the cap including the end face from a second portion of the cap which is received on the container, the second portion remaining on the container after separation of the first portion.

In another aspect the disclosure relates to fluid delivery system, including a container having a top wall in which an opening is formed, a bottom wall, and at least one container side wall extending between the top wall and the bottom wall defining a cavity for storing a material, a surface cleaning apparatus comprising a receiver configured to couple with the container, the receiver comprising at least one receiver fluid inlet, at least one receiver fluid outlet and a locking mechanism, and a cap received on the container to close the opening, the cap including an end face having at least one fluid outlet and at least one fluid inlet, and a side wall extending from the end face wherein the cap is separable along the side wall to separate a first portion of the cap including the end face from a second portion of the cap which is received on the container, the second portion remaining on the container after separation of the first portion.

DETAILED DESCRIPTION

Aspects of the disclosure generally relate to a container and cap assembly 10 for use with a surface cleaning device to dispense a treating chemistry to the surface being cleaned. The surface cleaning device can be any manual or powered floor cleaner known in the art for use in cleaning hard surfaces, such as wood, tile and vinyl floors, and soft surfaces, such as carpet, rugs, and upholstery. Non-limiting examples of surface cleaning devices include a stick mounted bare floor cleaner, a floor sweeper, a vacuum cleaner, a steam mop, a steam mop with vacuum cleaner, or a wet extraction cleaner. The treating chemistry can include one or more components, non-limiting examples of which include water, detergents, surfactants, solvents, fragrances, stain resist agents, anti-soiling agents, bleaches, peroxides and peroxygen containing compounds, anti-odor agents, stain removal agents, and combinations thereof.

Figure 1A:
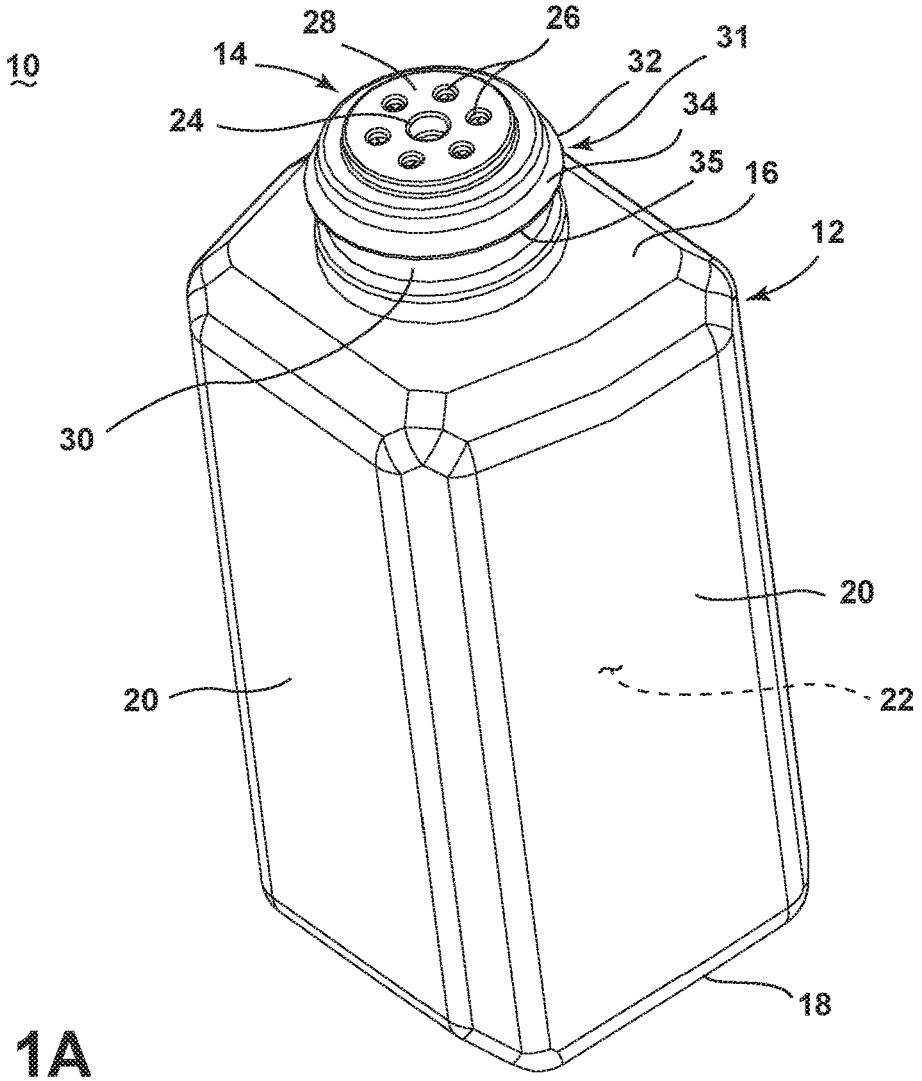
FIG. 1A is a perspective view of a container and cap assembly according to various aspects described herein.
Figure 1B:
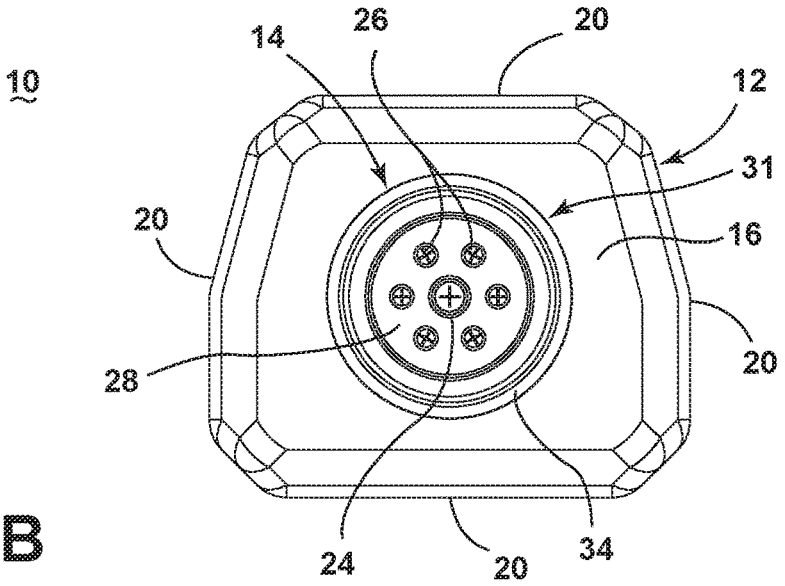
FIG. 1B is a top down view of the container and cap assembly of FIG. 1A.

Referring now to FIGS. 1A and 1B, the container and cap assembly 10 includes a container 12 and a closure or cap 14. The container 12 can include a top wall 16, a bottom wall 18 and a plurality of sidewalls 20 extending between the top wall 16 and the bottom wall 18 defining a cavity 22 for storing a treating chemistry. The container 12 can have a generally cuboid shape having rectangular sidewalls, as illustrated, square sidewalls or any other regular or irregular shape, such as trapezoidal shaped sidewalls, for example. The illustrated shape and dimensions of the container 12 are for illustration. Any suitably shaped and dimension container may be used. The cap 14 can be made from any suitable polymeric material, such as polypropylene or high density polyethylene, for example. The container 12 can be made from any suitable polymeric material or glass, for example, as is known in the art.

The cap 14 can be received adjacent the top wall 16 and comprise a liquid outlet 24 and a plurality of air inlets 26 located in an end face 28 of the cap 14. The cap 14 can further include an annular sidewall 30 having a retaining element 31 in the form of a shoulder 32 having an outwardly angled or flared camming surface 34 and an underside or engaging surface 35. The outwardly angled camming surface 34 can extend from the annular side wall 30 at an angle with respect to a longitudinal axis extending through the end face 28. While the shoulder 32 and camming surface 34 are illustrated as extending all the way around the perimeter of the cap 14, it will be understood that it is within the scope of the present disclosure for the shoulder 32 and camming surface 34 to extend around only a portion of the perimeter of the cap 14.

Figure 2:
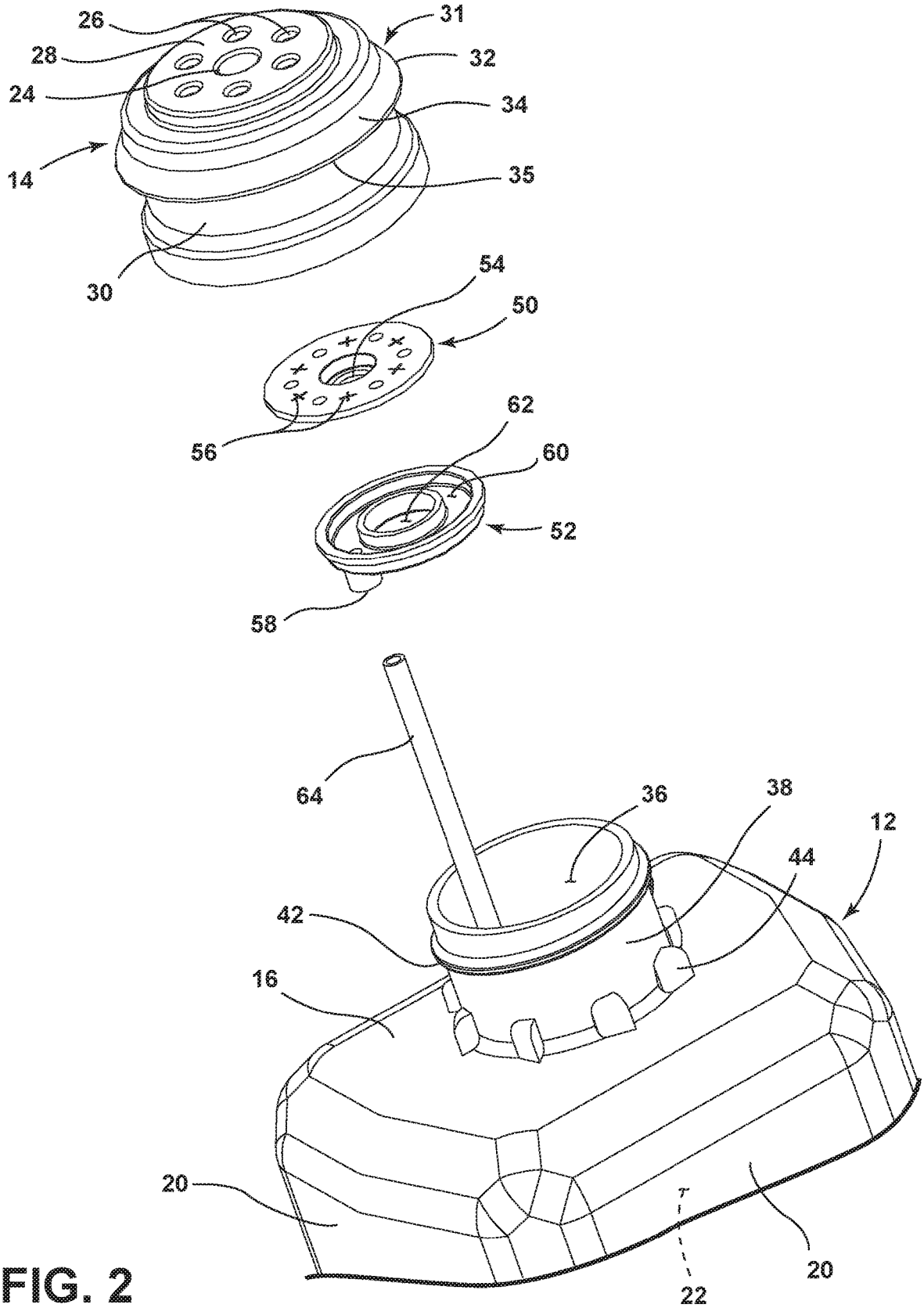
FIG. 2 is an exploded view of the container and cap assembly of FIG. 1A.

Referring now to FIG. 2, the container 12 can include an opening 36 defined by a neck 38 projecting from the top wall 16. The neck 38 can be configured so as to receive the cap 14 for closing the opening 36 to the container 12. The cap 14 can be coupled with the neck 38 through threads 40 provided on the cap 14 (FIG. 7) that are configured to mate with threads 42 provided on the neck 38. The neck 38 can optionally include a plurality of lugs 44 which engage corresponding lugs on the cap 14 (not shown) to limit rotation of the cap 14 relative to the neck 38 once the cap 14 has been threaded onto the neck 38. Additionally, alternative fastening mechanisms known in the art can also be used to couple the cap 14 with the neck 38, such as snap-fit mechanism, for example.

Still referring to FIG. 2, the cap 14 can be provided with a first seal 50 and a second seal 52. The first seal 50 includes a liquid outlet valve 54 that is configured to fluidly seal the liquid outlet 24 when the first seal 50 is positioned adjacent an underside of the end face 28 of the cap 14. The first seal 50 also includes a plurality of air inlet valves 56 configured to align with and fluidly seal the air inlets 26 in the cap 14. As used herein, the term fluid refers to either or both gas and liquid. The second seal 52 is configured to fluidly connect the plurality of air inlet valves 56 with an air tube outlet 58 through a channel 60 when the second seal 52 is positioned adjacent the first seal 50. The second seal 52 also includes an opening 62 which is configured to align with the liquid outlet valve 54. The air tube outlet 58 may be configured to receive an optional air tube 64 which projects into the cavity 22 of the container 12.

The first and second seals 50, 52 can be made from any suitable resilient material, such as silicone, for example. The liquid outlet valve 54 and air inlet valve 56 can be in the form of one-way, compliant seals which open in one direction when a predetermined pressure, often referred to as the cracking pressure, is applied and reclose when the pressure decreases below the predetermined pressure.

Figure 3:
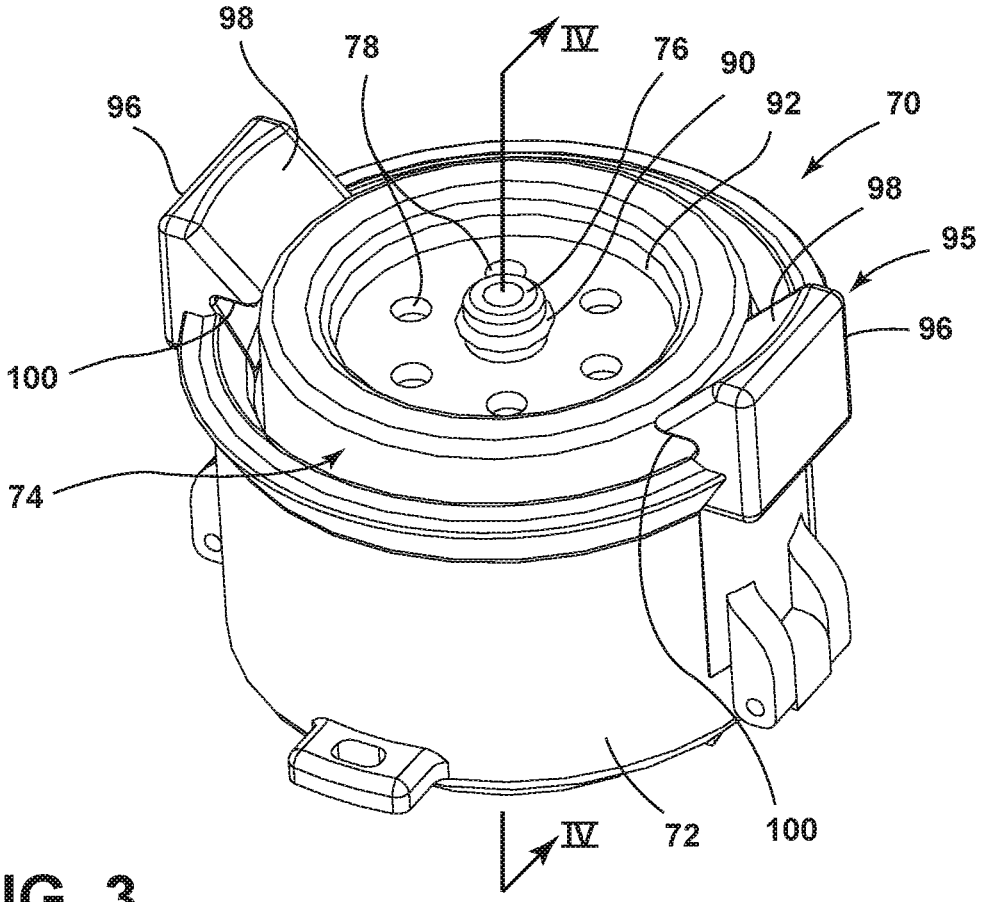
FIG. 3 is a perspective view of a receiver of a surface cleaning device according to various aspects described herein.
Figure 4:
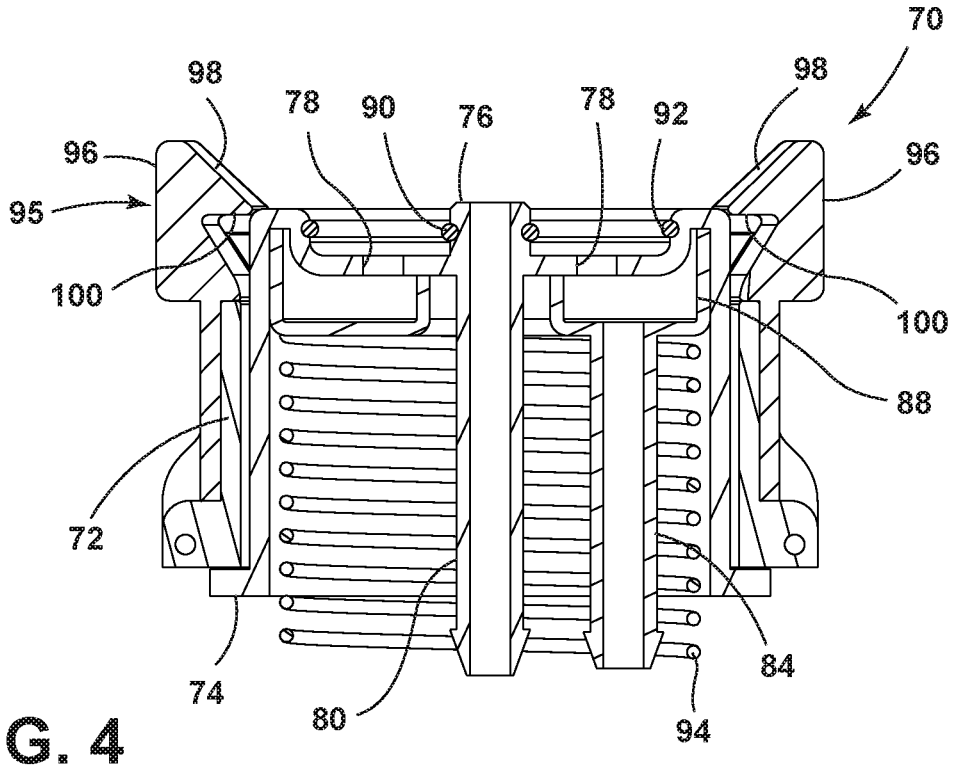
FIG. 4 is a cross-sectional view of the receiver of FIG. 3 along the line IV-IV.

FIGS. 3 and 4 illustrate an exemplary receiver 70 that can be provided on any suitable surface cleaning device, such as a vacuum cleaner of bare floor stick cleaner, for example, that can receive the container and cap assembly 10 for dispensing a treating chemistry to the surface to be cleaned. The receiver 70 includes a receiver neck 72 and a receiving element 74 which is moveable with respect to the receiver neck 72. The receiver neck 72 can be mounted to a housing of the surface cleaning device or integrally formed with the housing of the surface cleaning device.

The receiving element 74 includes a liquid inlet 76 and a plurality of air outlets 78. As can be seen best in FIG. 4, the liquid inlet 76 is fluidly coupled with a liquid connector portion 80, which can be coupled with a liquid flow circuit of a surface cleaning device. The air outlets 78 are fluidly coupled with an air connector portion 84, which can be coupled with an air flow circuit of a surface cleaning device. The plurality of air outlets 78 are all fluidly coupled with the air connector portion 84 through an air channel 88. The receiving element 74 can also include a first gasket or O-ring 90 adjacent the liquid inlet 76 and a second gasket or O-ring 92 circumferentially spaced from the first O-ring 90 and encompassing the air outlets 78. The receiving element 74 also includes a biasing element 94, such as a spring, for example, for biasing the receiving element 74 with respect to the receiver neck 72.

The receiver neck 72 includes a locking mechanism 95 for coupling the cap 14 with the receiving element 74 in the form of a pair of inwardly biased locking arms 96. The locking arms 96 include an angled or flared receiving face 98 and a locking shoulder 100. The locking arms 96 can include a biasing element, such as a spring (not shown), or can be formed from a resilient material, for example.

Figure 5A:
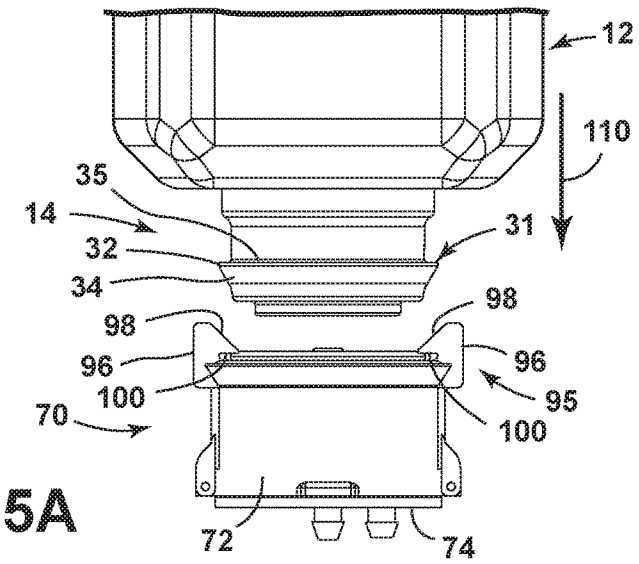
FIGS. 5A-5D illustrate a process of coupling a container and cap assembly with a receiver of a surface cleaning device according to various aspects described herein.
Figure 5B:
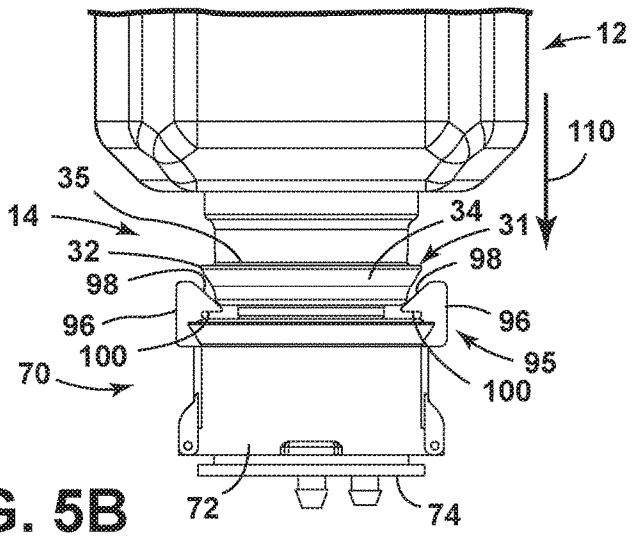
Figure 5C:
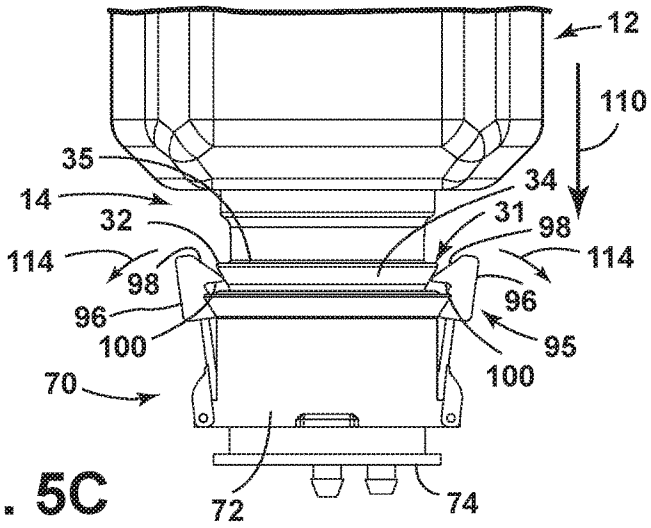
Figure 5D:
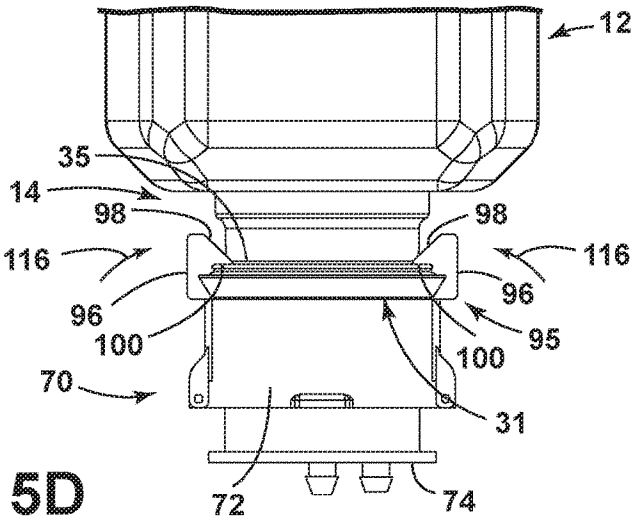

FIGS. 5A-5D illustrate the manner in which the container and cap assembly 10 can be coupled with the receiver 70. FIG. 5A illustrates the receiver 70 in which the receiving element 74 and locking arms 96 are in an uncoupled state. The container 12 can be moved toward the receiver 70, as illustrated by arrow 110 to bring the cap 14 into contact with the receiving element 74. As illustrated in FIGS. 5B and 5C, as the container 12 is pressed into the receiver neck 72 towards the receiving element 74, the receiving element 74 moves relative to the receiver neck 72 against the bias of the biasing element 94, in the direction illustrated by arrow 110, and the shoulder 32 of the cap 14 abuts the receiving face 98 of the locking arms 96. Continued movement of the container 12 causes the locking arms 96 to ride along the camming surface 34 of the shoulder 32 and flex outwardly with respect to the receiving element 74 against the bias of the locking arm 96, as indicated by arrows 114. As the shoulder 32 of the cap 14 moves past the receiving face 98 of the locking arms 96, the locking arms 96 flex inward due to the bias of the locking arms 96, as illustrated by arrows 116 in FIG. 5D, and the locking shoulder 100 abuts the underside 35 of the shoulder 32. The surface cleaning device and/or the receiver 70 can include features to limit further movement of the receiving element 74 relative to the receiver neck 72, non-limiting examples of which include a rib or other stop that engages the receiving element 74 to limit further movement. In another example, the biasing element 94 and/or the surface supporting the biasing element 94 can limit movement of the receiving element 74.

Figure 6:
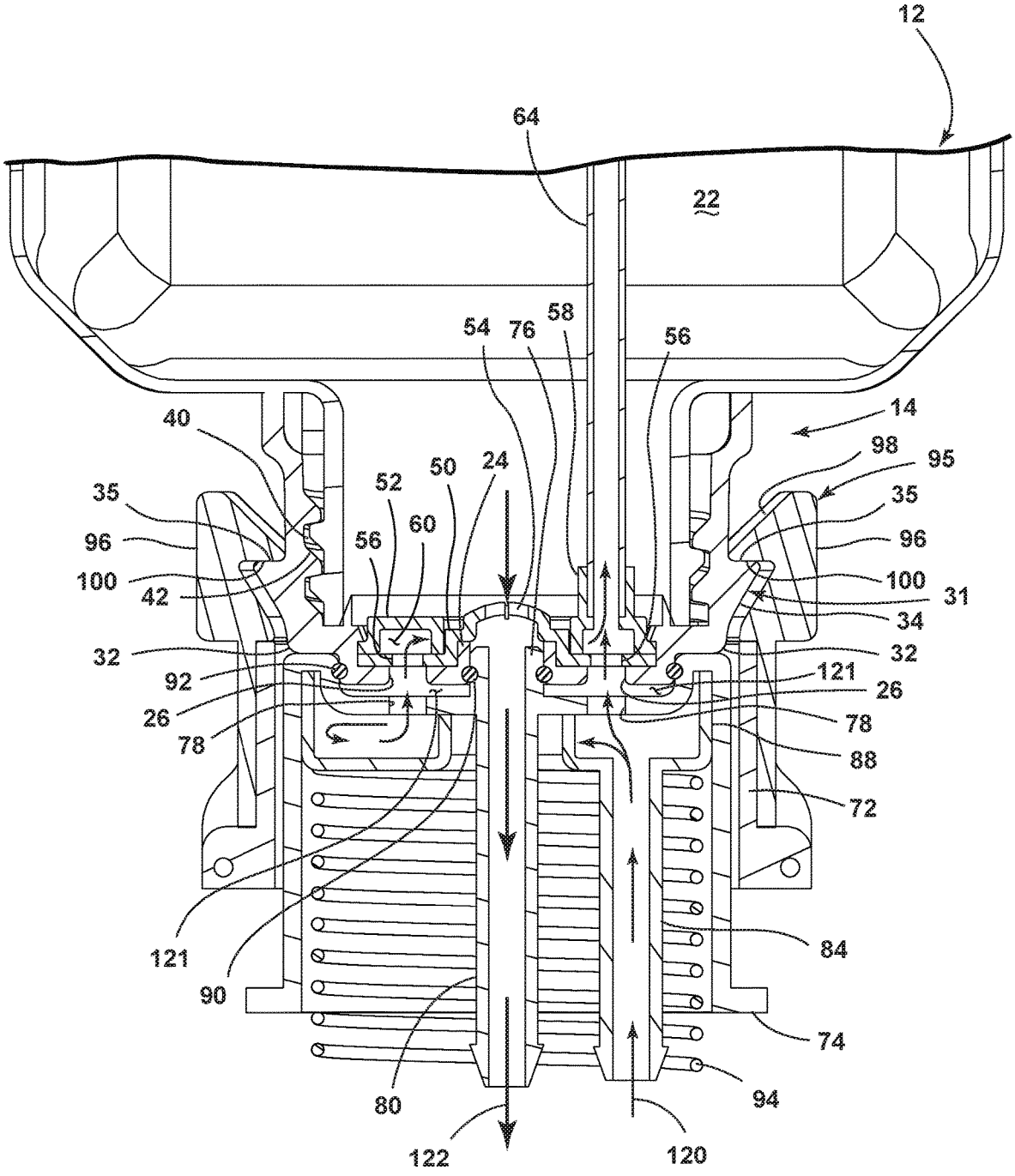
FIG. 6 is a cross-sectional view of a container and cap assembly coupled with a receiver of a surface cleaning device according to various aspects described herein.

Referring now to FIG. 6, the shoulder 32 of the cap 14 is configured to engage the locking arms 96 such that the end face 28 of the cap 14 is retained against the receiving element 74 against the bias of the biasing element 94. The opposing forces of the locking arms 96 and the biasing element 94 provide a sealing force that provides a fluid tight seal between the cap 14 and the receiving element 74 to minimize leakage during use and coupling and uncoupling of the container and cap assembly 10 with the receiver 70. The first and second O-rings 90, 92 also contribute to forming a fluid tight seal between the cap 14 and the receiving element 74.

While the locking mechanism 95 is illustrated as a pair of locking arms 96, it is within the scope of the present disclosure for the locking mechanism 95 to be provided in alternative forms. For example, the locking mechanism 95 can alternatively be provided as a ring that slides over the camming surface 34 of the cap 14 to engage the shoulder 32 to lock the cap 14 with the receiving element 74. The locking mechanism 95 can include any structure configured to slide over the camming surface 34 to engage the shoulder 32 to retain the cap 14 against the receiving element 74 and to provide an opposing force to the bias of the receiving element 74.

To disengage the container and cap assembly 10 from the receiver 70, the locking arms 96 can be flexed outwardly by the user. The bias on the receiving element 74 will cause the receiving element 74 to move relative to the receiver neck 72 such that the cap 14 is ejected from within the receiver neck 72.

Still referring to FIG. 6, when the cap 14 is coupled with the receiver 70, the liquid outlet 24 and the air inlets 26 of the cap 14 are fluidly coupled with the liquid inlet 76 and the air outlets 78, respectively, of the receiving element 74, such that air can be pumped into the container 12 and liquid stored within the container 12 can be dispensed from the container 12. As illustrated by arrows 120, air can be pumped into the receiver 70 through the air connector portion 84, which can be connected with a supply of air, as will be discussed with respect to FIG. 7 below. The air 120 flows from the air connector portion 84 into the air channel 88 where it can exit the receiving element 74 through the plurality of air outlets 78 into a chamber 121 formed between the cap 14 and the receiving element 74. The air provided into the chamber 121 enters the cap 14 through the air inlets 26. Providing the chamber 121 between the coupled cap 14 and the receiving element 74 means that it is not necessary for the air outlets 78 of the receiving element 74 to align with the air inlets 26 of the cap 14 to provide air to the cavity 22 of the container 12. The first and second O-rings 90, 92 provide a fluid seal for the chamber 121.

At a predetermined pressure, the air inlet valves 56 in the cap 14 open and allow the air 120 to enter the air channel 60 in the second seal 52 which is fluidly connected with the air tube 64 through the air tube outlet 58. The air 120 flows through the air tube 64 into the cavity 22 of the container 12, pressurizing the contents of the container 12. At a predetermined pressure, the liquid outlet valve 54 in the cap 14 opens, allowing the contents of the container 12 to flow out of the container 12 to the liquid connector portion 80 of the receiver 70 through the liquid outlet 24 in the cap 14 and the liquid inlet 76 of the receiving element 74, as illustrated by arrows 122.

The air inlet valves 56 are configured as one-way seals such that the seals will close when the pressure from the air flow drops below a predetermined pressure to minimize leakage of fluid from the container 12 through the air inlet valves 56. Similarly, the liquid outlet valve 54 is configured as a one-way seal that opens when the pressure inside the container 12 reaches a predetermined pressure to allow liquid to flow out of the container 12 and closes when the pressure drops below the predetermined pressure to minimize leakage.

Figure 7:
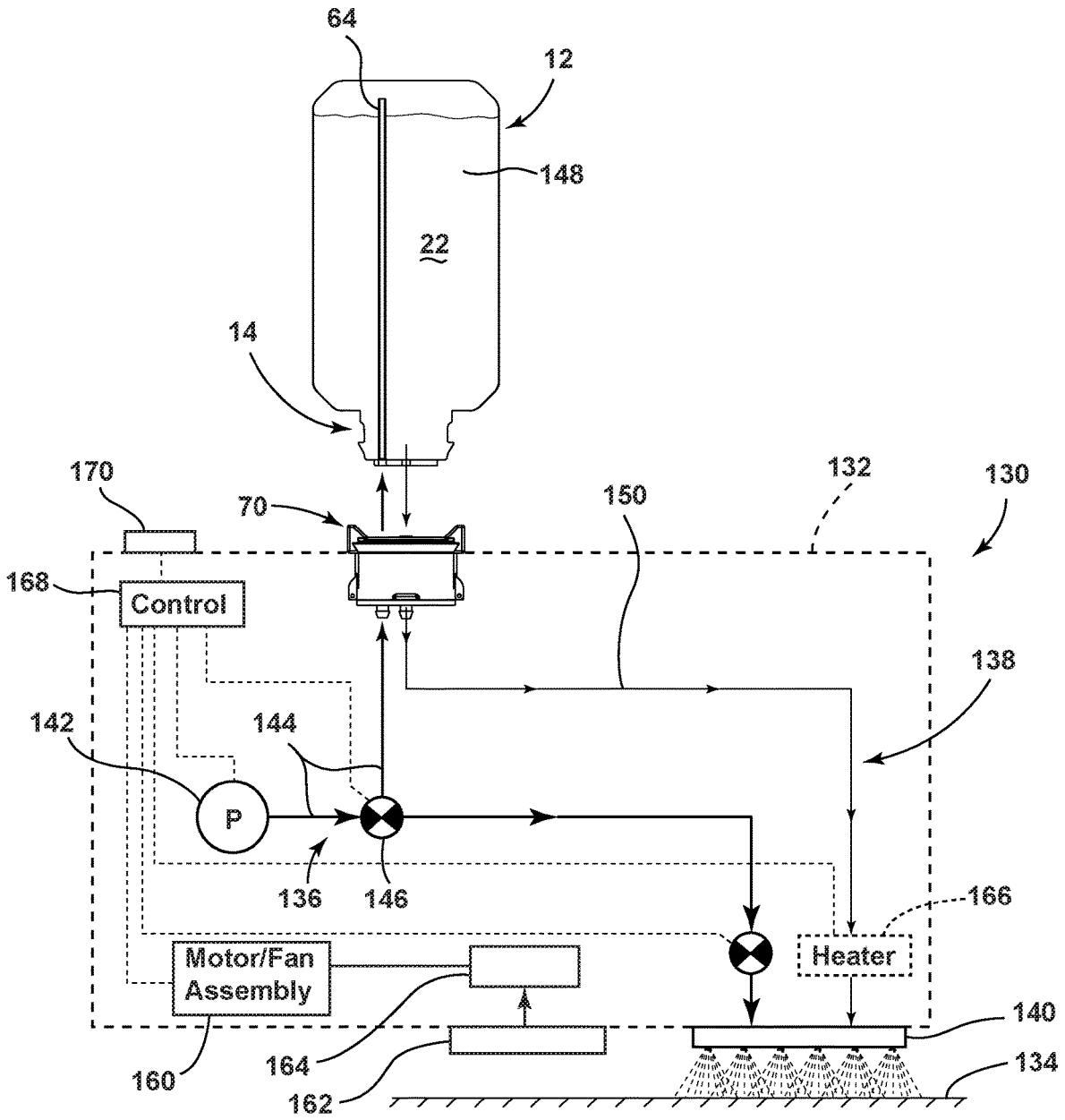
FIG. 7 is a schematic representation of a surface cleaning device including a recovery system and having a receiver for use with a container and cap assembly according to various aspects described herein.

FIG. 7 is a schematic representation of an exemplary fluid delivery system 130 which may be incorporated into any suitable surface cleaning device 132, such as a vacuum cleaner or an extraction cleaner, for example, that can be used with the container and cap assembly 10 for delivering a treating chemistry solution to a surface 134 to be cleaned. The fluid delivery system 130 includes an air flow circuit 136 and a liquid flow circuit 138. The air flow circuit 136 and liquid flow circuit 138 fluidly couple the receiver 70 with a dispenser 140, which can be part of a foot assembly (not shown), and which is configured to dispense a treating chemistry solution onto the surface 134.

The air flow circuit 136 includes a pump 142 coupled with the receiver 70 through an air conduit 144 that includes a valve 146. The pump 142 is configured to provide air to the container 12 through the receiver 70 when the container is coupled with the receive 70, as illustrated in FIG. 6, to pressurize the contents of the container 12 and displace a treating chemistry 148 stored within the container 12. The liquid flow circuit 138 includes a liquid conduit 150 that fluidly couples the receiver 70 with the dispenser 140. The air flow circuit 136 and liquid flow circuit 138 can include additional valves which are not shown.

The surface cleaning device 132 can also include a recovery system comprising a motor/fan assembly 160 that is fluidly coupled with a nozzle assembly 162 for providing suction to draw debris and optionally spent treating chemistry solution on the surface 134 through the nozzle assembly 162 and into a recovery chamber 164. The nozzle assembly 162 can be part of a foot assembly (not shown) configured to be positioned adjacent the surface to be cleaned during use of the surface cleaning device 132. The foot assembly can further include additional components such as an agitator assembly comprising one or more agitators, such as a brush roll, for example, for agitating and providing mechanical cleaning action to the surface to be cleaned, as is known in the art of vacuum cleaners and extractors.

The recovery system can be configured to recover either or both dry and wet material from the surface 134. For example, the recovery system can be part of an extraction cleaner which is configured to recover both dry and wet material from the surface being cleaned. Non-limiting examples of suitable extraction cleaners include those described in commonly assigned U.S. Pat. No. 6,131,237 to Kasper et al., U.S. Pat. No. 7,784,148 to Lenkiewicz et al., and U.S. Pat. No. 7,320,149 to Huffman et al., which are incorporated herein by reference in their entirety. Alternatively, the recovery system can be configured to recover only dry material, such as is common on a traditional vacuum cleaner. In another example, the recovery system can be part of a vacuum cleaner that is configured to recover both dry and wet material.

The fluid delivery system 130 can also include an optional heater 166 that can be any suitable heater configured to heat fluids, such as an in-line heater, for example.

The surface cleaning device 132 can also include a control system 168 for operably controlling various components of the surface cleaning device 132, such as the pump 142, valve 146, motor/fan assembly 160 and heater 166, for example. The surface cleaning device 132 can further include an actuator 170, such as a button or trigger, which can be selectively actuated to control the delivery of the treating chemistry solution from the container 12 to the dispenser 140 for delivery to the surface 134.

In use, upon actuation of the actuator 170 by a user, the control system 168 can control the pump 142 to pump gas, which may simply be ambient air, through air conduit 144 to the receiver 70 where it can flow into the container 12 through the cap 14 and the air tube 64, as described above with respect to FIG. 6. The air pumped into the container 12 through the air tube 64 pressurizes the cavity 22 of the container 12 which causes the treating chemistry 148 to flow out of the container 12 through the cap 14 to the coupled receiver 70, which is coupled with the liquid flow circuit 138. The treating chemistry 148 flows through the liquid conduit 150 to the dispenser 140 where can be dispensed onto the surface 134.

The controller 168 can be configured to control the pump 142 to pump air into the container 12 for a predetermined time upon actuation of the actuator 170. Alternatively, the pump 142 can be controlled to pump air into the container 12 only while the actuator 170 remains actuated. In this configuration, upon release of the actuator 170 by the user, the controller 168 can control the pump 142 to stop pumping air into the container 12. Without air being pumped into the container 12, the pressure inside the container 12 will decrease and at a predetermined pressure the liquid outlet valve 54 closes and stops the flow of treating chemistry 148 out of the container 12.

The heater 166 can optionally be actuated upon actuation of the actuator 170 or a second, separate actuator (not shown) to heat the treating chemistry solution delivered to the dispenser 140 through the liquid flow circuit 138.

Following the dispensing of the treating chemistry 148 to the surface 134, the treating chemistry 148 can be left on the surface 134 or can be recovered by the recovery system of the surface cleaning device 132 depending on the type of recovery system and the treating chemistry being used. For example, the treating chemistry 148 may be configured to remain on the surface 134 for a predetermined period of time and recovered from the surface while still at least partially in liquid form. This type of treating chemistry would primarily be used with a surface cleaning device 132 in the form of an extraction cleaner or a modified vacuum cleaner having a recovery system configured to recover wet material from the surface 134, which can then be used to recover the dispensed treating chemistry solution from the surface 134 through the nozzle assembly 162. Alternatively, the treating chemistry 148 may be configured to remain on the surface 134 until dry and then any type of recovery system, either a traditional dry recovery system on a vacuum cleaner or wet/dry recovery system of an extraction cleaner can be used to recover the dried treating chemistry 148 from the surface 134 through the nozzle assembly 162. In another example, the treating chemistry 148 may be configured to remain on the surface 134 until dry and either remain with the surface or evaporate.

In addition, while the treating chemistry 148 is illustrated as being dispensed directly to the surface 134 through the liquid flow circuit 138, it is also within the scope of the present disclosure for the treating chemistry 148 to be diluted or mixed with an additional treating chemistry prior to being dispensed onto the surface 134. For example, the liquid flow circuit 138 can be provided with a mixing chamber that is fluidly coupled with the receiver 70 for receiving the treating chemistry 148 from the container 12 and an additional supply of a treating chemistry. Non-limiting examples of an additional supply of a treating chemistry includes a tank holding water or some other solvent for diluting the treating chemistry 148 or another treating chemistry that is different from the treating chemistry 148, such as a fragrance or a treating chemistry that should be stored separately from the treating chemistry 148. The two supplies of treating chemistry can be mixed in the mixing chamber and then supplied to the dispenser 140 through the liquid flow circuit 138 for delivery to the surface 134.

Figure 8:
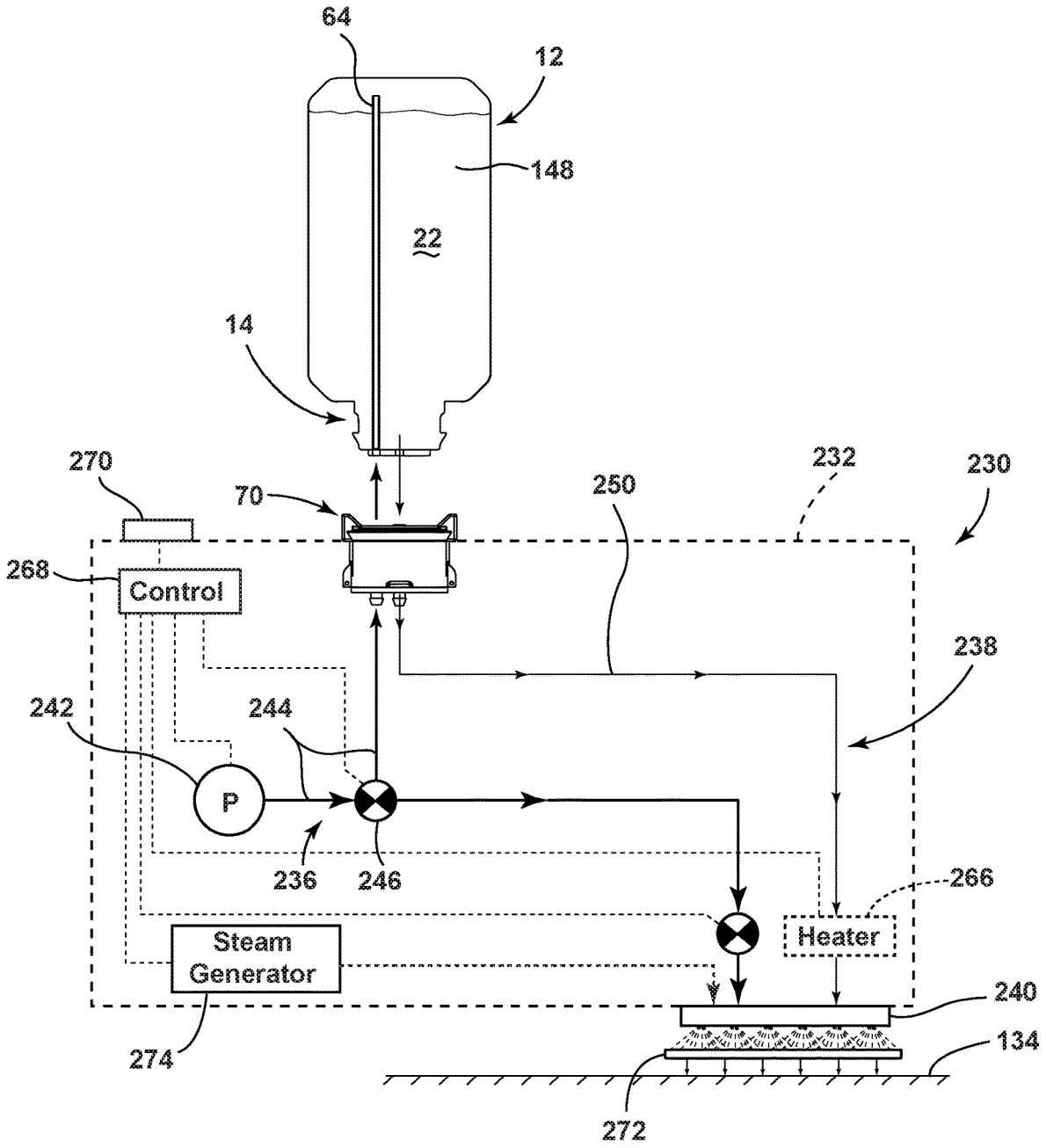
FIG. 8 is a schematic representation of a surface cleaning device having a receiver for use with a container and cap assembly according to various aspects described herein.

FIG. 8 illustrates another example of a surface cleaning device 232, which is similar to the surface cleaning device 132 except that the surface cleaning device 232 is configured as a bare floor cleaner, such as a mop or steam mop, for example, and does not include a recovery system. Therefore, parts of the surface cleaning device 232 similar to the surface cleaning device 132 will be labeled with the prefix 200.

The surface cleaning device 232 can include a cleaning head 240 which is configured to dispense a treating chemistry supplied to the cleaning head 240 by the liquid flow circuit 238 to a cleaning pad 272. The cleaning pad 272 can be removably attached to the cleaning head 240 for applying a treating chemistry to the surface 134. The cleaning pad 272 can be moistened with the treating chemistry and then the treating chemistry can be applied to the surface 134 by wiping or scrubbing the moistened cleaning pad 272 over the surface 134.

The fluid delivery system 230 includes a liquid flow circuit 238 that can optionally be provided with a heater 266 to heat the treating chemistry in the liquid flow circuit 238 and/or to generate steam. Alternatively, the surface cleaning device 232 can be provided with a separate steam generator 274 which can provide steam to the cleaning head 240 as an alternative to or in addition to the treating chemistry supplied to the cleaning head 240 by the liquid flow circuit 238.

The delivery of the treating chemistry 148 from the container 12 to the surface 134 by the surface cleaning device 232 is similar to that described above for the surface cleaning device 132 with respect to FIG. 7. Upon actuation of the actuator 270, the controller 268 controls the pump 242 to pump air into the container 12 to pressurize the cavity 22 of the container 12, causing the treating chemistry 148 to flow out of the container 12 to the cleaning head 240 through the liquid flow circuit 238. The treating chemistry 148 can be delivered to the cleaning pad 272 attached to the cleaning head 240 for application to the surface 134.

Alternatively, the treating chemistry 148 can be heated by the heater 266 prior to delivery to the cleaning pad 272 to provide a heated treating chemistry solution to the surface 134. In one example, the treating chemistry 148 can be heated by the heater 266 to a high enough temperature to generate steam, such that the treating chemistry 148 is supplied to the cleaning pad 272 as steam.

In the example in which the surface cleaning device 232 includes the steam generator 274, such as when the surface cleaning device 232 is in the form of a steam mop, the steam generator 274 can be actuated upon actuation of the actuator 270 to also supply steam to the cleaning pad 272 when the treating chemistry 148 is supplied to the cleaning pad 272. Alternatively, actuation of the steam generator 274 can be controlled separately from the dispensing of the treating chemistry 148 such that steam can be supplied to the cleaning pad 272 at the same or a different time from the treating chemistry 148.

While the surface cleaning device 232 is disclosed as having a cleaning head 240 which supplies the treating chemistry 148 to a cleaning pad 272, it is also within the scope of the present disclosure for the cleaning head 240 to be configured to dispense the treating chemistry 148 directly the surface 134. For example, when the surface cleaning device 232 is in the form of a steam mop, the cleaning head 240 can be configured to provide steam to the cleaning pad 272 for application to the surface 134 and to provide the treating chemistry 148 directly to the surface 134.

The locking mechanism 95 on the receiver 70 and the camming surface 34 and shoulder 32 on the cap 14 are configured to work together to retain the container 12 within the receiver 70 against the bias of the biasing element 94 to provide a seal between the cap 14 and the receiving element 74 sufficient to allow air to be pumped into the container 12 to push liquid out of the container 12. A container having a cap that does not include the camming surface 34 and/or shoulder 32 may not be able to engage the receiver 70 in a manner that allows the container to dispense the contents of the container and/or provides acceptable performance to a user.

For example, a cap that does not include the camming surface 34 may not be able to engage the locking mechanism 95 in such a way that the container can be inserted all the way into the receiver 70. In the example with the locking arms 96, a cap without the camming surface 34 may not be able to both flex the locking arms 96 outward to allow the cap to be inserted all the way into the receiver 70 and allow the locking arms 96 to flex inward to retain the cap against the biased receiving element 74. Similarly, if the cap does not include the shoulder 32, the locking mechanism 95 may not be able to retain the cap within the receiver 70 against the biased receiving element 74. This could result in the cap being unable to form a suitable seal with the receiving element 74, which could result in poor dispensing performance and/or leakage of liquid from the container. In some instances, without the locking mechanism 95 engaging the cap, the container and cap could be ejected from the receiver 70.

Configuring the receiver 70 to only work with containers having a cap with a predetermined feature or features, such as the camming surface 34 and shoulder 32, for example, can limit the ability of a user to use unauthorized or unsuitable treating chemistries. For example, some treating chemistries that are suitable for use in a steam mop may not be suitable for use in a vacuum cleaner. A container having a cap that does not properly engage the receiver 70 can provide a warning to the user that the treating chemistry might not be suitable for that particular surface cleaning device or may not be a container from a pre-approved supplier.

The cap 14 described above is configured to work with a fluid delivery system that can supply air to the interior of the container to dispense the contents of the container. However, there are other types of fluid delivery systems which do not operate in this manner. For example, some fluid delivery systems may utilize a pump to simply pump the contents of the container from the container for delivery to the surface being cleaned. Other fluid delivery systems may rely on gravity to dispense the contents of the container and utilize a valve to control the flow of the contents from the container. Therefore, it may be desirable to provide a container and cap assembly that can work with more than one type of fluid delivery system.

Figure 10:
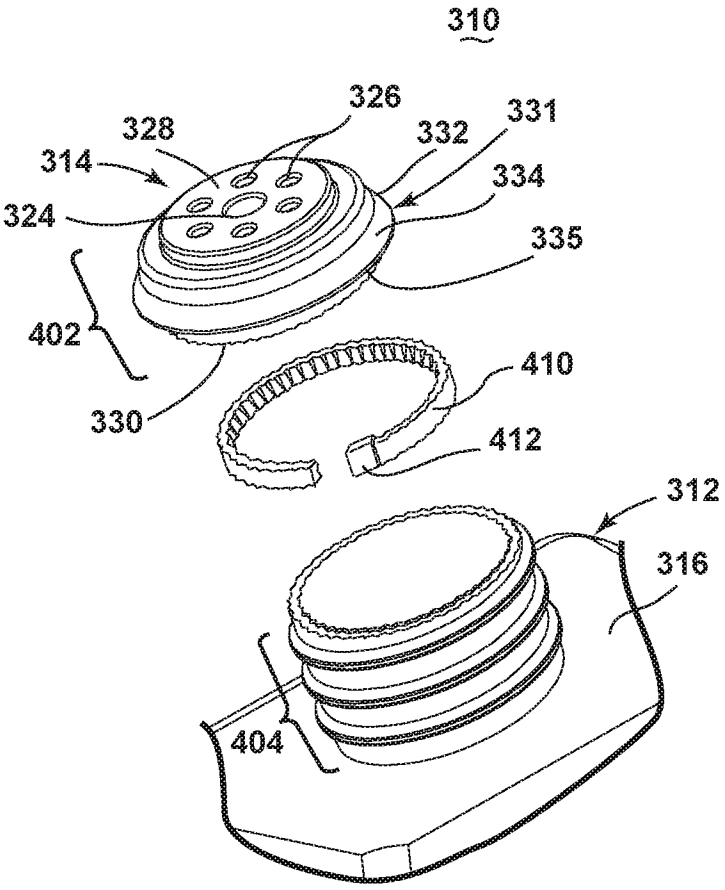
FIG. 10 is a partial exploded view of the container and cap assembly of FIG. 9.
Figure 9:
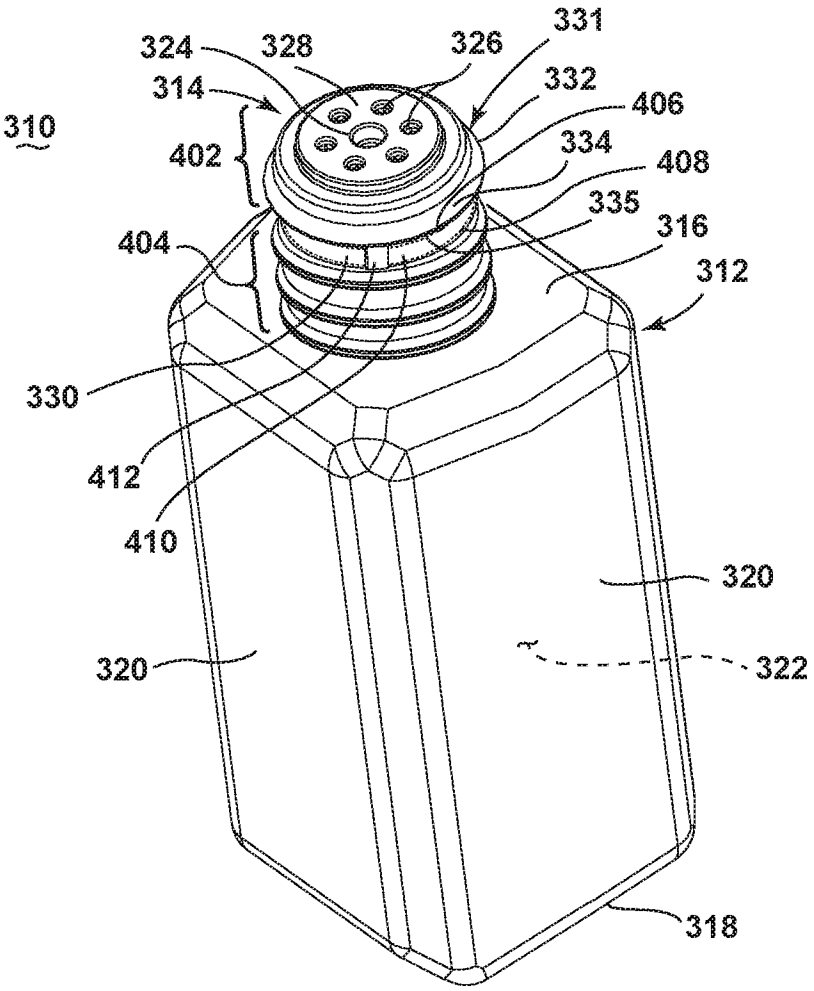
FIG. 9 is a perspective view of another container and cap assembly according to various aspects described herein.

FIGS. 9 and 10 illustrate a container and cap assembly 310 similar to the container and cap assembly 10 except for the cap 314. The cap 314 is similar to the cap 14 of FIGS. 1-2 above except that the cap 314 can be separated into a first portion 402 and a second portion 404. Therefore elements of the container and cap assembly 310 similar to that of container and cap assembly 10 will be labeled with the prefix 300.

Still referring to FIG. 9, the first portion 402 of the cap 314 can include the shoulder 332 and camming surface 334 such that the cap 314 can be used with the receiver 70 in the same manner as described above with respect to the cap 14. The first portion 402 can be configured to be removable from the container 312 such that the container 312 can be used with a surface cleaning device that does not have the receiver 70 but rather has a different receiver/fluid delivery system.

In one example, the cap 314 can be provided with one or more lines of weakness such that the first portion 402 can be separated from the second portion 404. For example, first and second lines of weakness 406 and 408 can be provided in a portion of the cap 314 below the shoulder 332 in the annular sidewall 330. The first and second lines of weakness 406 and 408 can be provided as a thinned portion of the annular sidewall 330 having a thickness less than the thickness of the adjacent portions of the annular sidewall 330 and defining a removable portion 410 of the cap 314. The removable portion 410 can be provided with a tab 412 that can be grasped by a user.

The container and cap assembly 310 can be coupled with the receiver 70 in the same manner as described above with respect to the container and cap assembly 10. The cap 314 can be inserted into the receiver 70 and the locking mechanism 95 can move relative to the camming surface 334 to engage the shoulder 332 in a manner similar to that described above for the cap 14 in FIGS. 5A-5D to retain the cap 314 against the receiving element 74. In this manner, the container and cap assembly 310 can be used to deliver a treating chemistry solution to a surface 134 to be cleaned similar to the container and cap assembly 10, such as through the surface cleaning device 132 or 232 of FIGS. 7 and 8.

Alternatively, the container and cap assembly 310 can be coupled with a surface cleaning device having a receiver that is different than the receiver 70 that is configured to mate with the second portion 404 of the cap 314. In the example illustrated in FIGS. 9 and 10, the second portion 404 of the cap 314 can be provided with threads that can couple with a receiver having corresponding mating threads. In another example, the second portion 404 can be configured to snap-fit with a receiver on another surface cleaning device. The second portion 404 can be configured in any suitable manner depending on the receiver of the device for which the container 312 is intended for use to couple with receiver and deliver the contents of the container 312 to the device. In this manner, the container 312 can be used to supply cleaning chemistry to a variety of different surface cleaning devices having different receivers. The container 312 can also be provided with a removable cover (not shown) that seals the container 312 over the cap 314 before and after the first portion 402 has been removed.

The cap 314 having first and second portions 402 and 404, respectively, can be used to provide consumers with who purchase new surface cleaning devices having the receiver 70 and consumers with previous models of surface cleaning devices that utilize a different receiver and dispensing system with the same chemistry in a single container. This can be beneficial to the supplier of the treating chemistry in that a single container can be provided to retailers for sale to consumers rather than two different containers that can take up valuable retail space and possibly confuse the consumer.

Figure 11A:
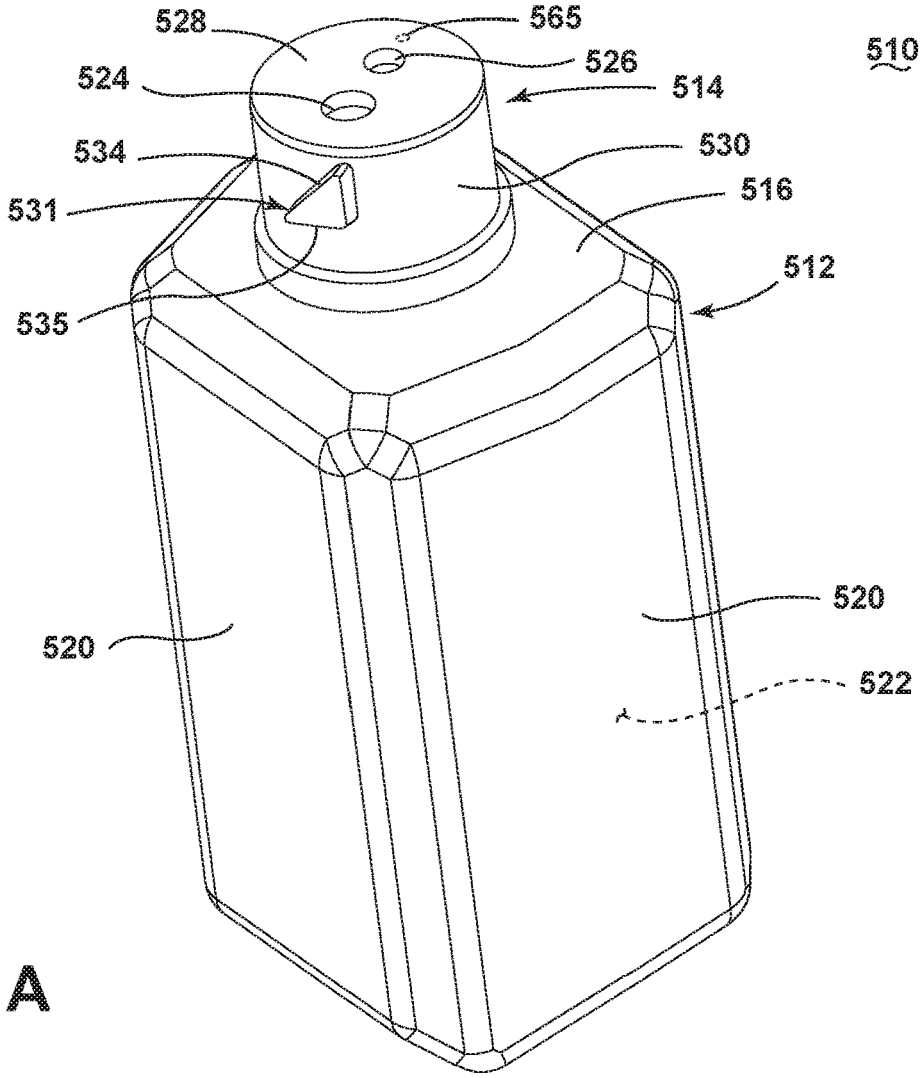
FIG. 11A is a perspective view of another container and cap assembly according to various aspects described herein.
Figure 11B:
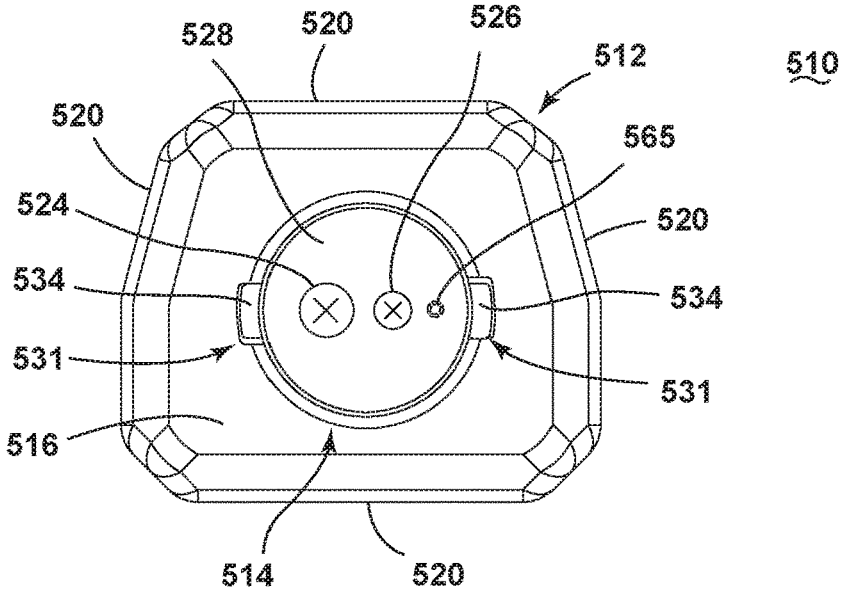
FIG. 11B is a top down view of the container and cap assembly of FIG. 11A.

FIGS. 11A and 11B illustrate another aspect of the present disclosure including a container and cap assembly 510, which is similar to the container and cap assembly 10, except for the configuration of the liquid outlet 524 and air inlet 526 in the cap 514. Therefore, elements of the container and cap assembly 510 similar to those of the container and cap assembly 10 are labeled starting with the prefix 500.

The cap 514 has an end face 528 which includes the liquid outlet 524, the air inlet 526 and an air leak 565 which can comprise one or more apertures in the end face 528. The cap 514 also includes a retaining element 531 in the form of a pair of retaining bosses protruding from the annular sidewall 530. The retaining boss 531 can include a camming surface 534 with an underside or engaging surface 535. The camming surface 534 is formed at an angle with respect to a lateral axis extending through the annular sidewall 530, parallel to the end face 528. While the retaining bosses 531 are illustrated as a pair of triangular shaped protrusions, it will be understood that the number of retaining bosses 531 can be fewer or greater and may have any other suitable geometric shape.

Figure 12:
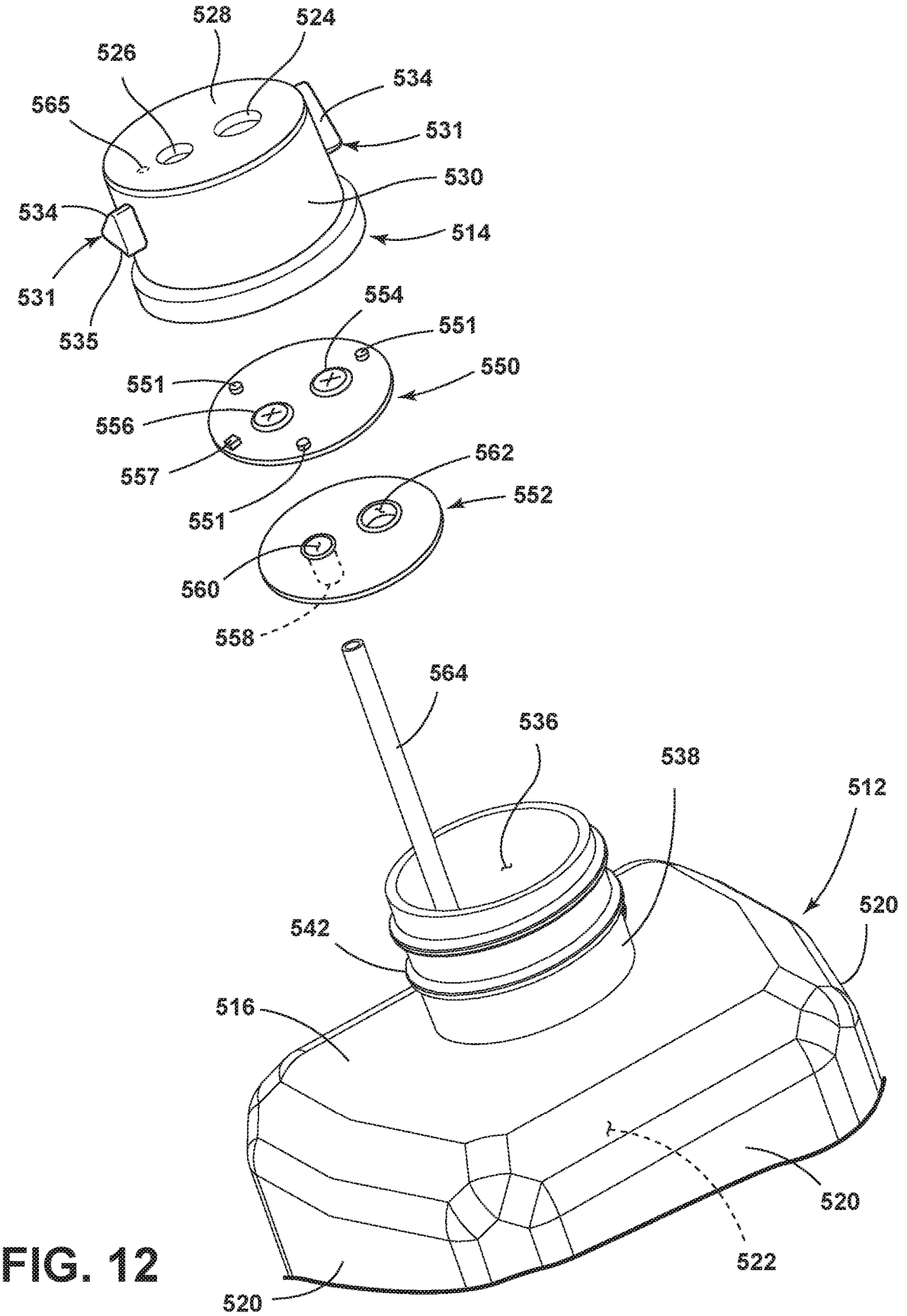
FIG. 12 is an exploded view of the container and cap assembly of FIG. 11A.

Referring now to FIG. 12, the cap 514 can include a first seal 550 and a second seal 552. The first seal 550 can include the liquid outlet valve 554 that is configured to fluidly seal the liquid outlet 524 when the first seal 550 is positioned adjacent the underside of the end face 528 of the cap 514. The first seal 550 also includes an air inlet valve 556 configured to align with and fluidly seal the air inlet 526 in the cap 514. The liquid outlet valve 554 and air inlet valve 556 can be in the form of one-way, compliant seals which open in one direction when a predetermined pressure is applied and reclose when the pressure decreases below the predetermined pressure.

The first seal 550 can also optionally include an air leak valve 557 configured to align with and fluidly seal the air leak 565. The first seal 550 can also optionally include one or more alignment bosses 551 which can be received within depressions in the underside of the cap 514 (not shown) to align the first seal 550 within the cap 514.

The second seal 552 includes an opening 562 which is configured to align with the liquid outlet valve 554 and a channel 560 which fluidly connects the air inlet valve 556 with the air tube 564 through an air tube outlet 558. While the container and cap assembly 510 is illustrated with an air tube 564 for supplying air within the container cavity 522, it is also within the scope of the present disclosure for the container and cap assembly 510 to not include an air tube 564, in which case the second seal 552 would not need to include the air tube outlet 558.

Figure 13:
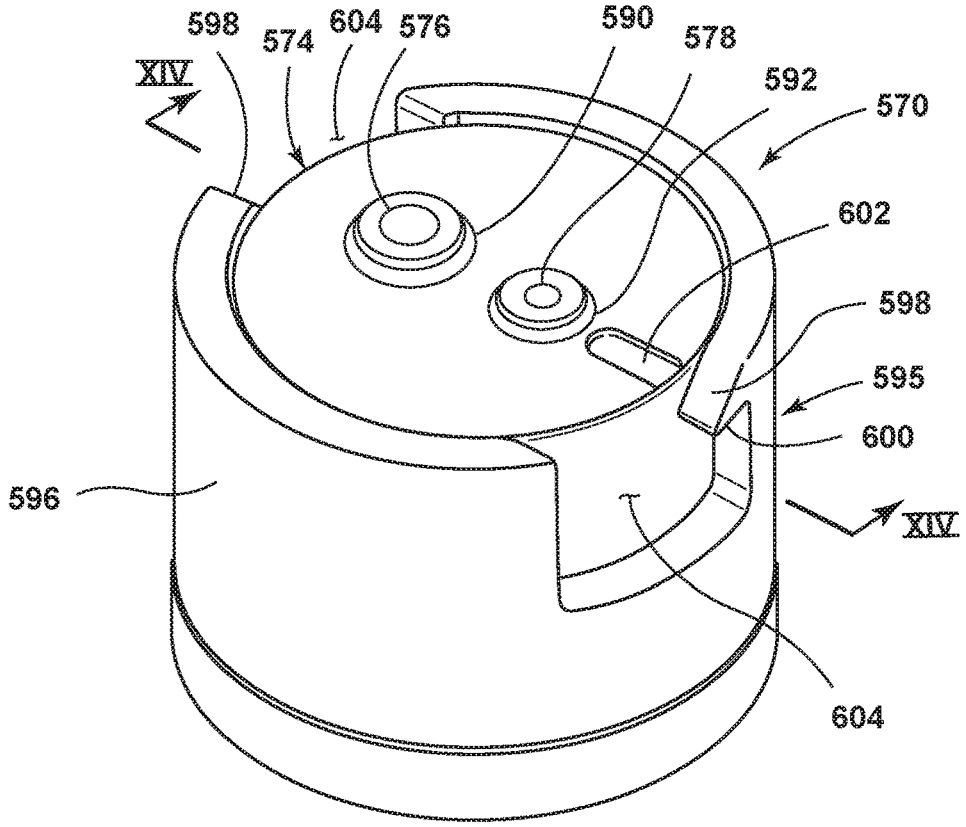
FIG. 13 is a perspective view of another receiver of a surface cleaning device according to various aspects described herein.
Figure 14:
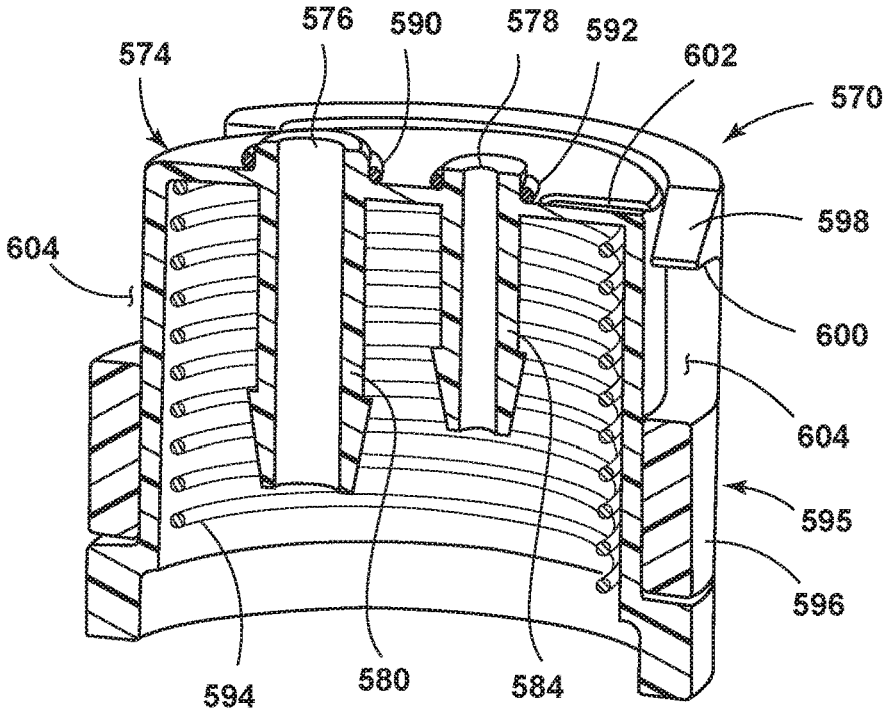
FIG. 14 is a cross-sectional view of the receiver of FIG. 13 along the line XIV-XIV.

FIGS. 13 and 14 illustrate an exemplary receiver 570 that is similar to the receiver 70 except for the configuration of the liquid inlet 576 and air outlet 578 and the locking mechanism 595. Therefore, elements of the receiver 570 similar to those of the receiver 70 are labeled starting with the prefix 500. The receiver 570 is configured to couple with the container and cap assembly 510 to dispense a treating chemistry to the surface to be cleaned through a suitable surface cleaning device which is provided with the receiver 570.

The receiver 570 includes a receiving element 574 which is moveable with respect to the locking mechanism 595 and the surface cleaning device and includes a biasing element 594, such as a spring, for example, for biasing the receiving element 74 with respect to the locking mechanism 595. The receiving element 574 includes the liquid inlet 576, air outlet 578 and an air leak groove 602 in an end face of the receiving element 574. As can best be seen in FIG. 14, the liquid inlet 576 is fluidly coupled to the liquid connector portion 580, which can be coupled with a liquid flow circuit of the surface cleaning device, and can be provided with a first gasket or O-ring 590. The air outlet 578 can be fluidly coupled with an air connector portion 584, which can be coupled with an air flow circuit of the surface cleaning device, and can be provided with a second gasket or O-ring 592.

The locking mechanism 595 can be in the form of a moveable locking ring or sleeve 596 which can rotate with respect to the receiving element 574 and can be biased with respect to the receiving element 574 with a biasing element (not shown), such as a spring, for example. The locking sleeve 596 can include a pair of openings 604 configured to receive the retaining elements 531 of the cap 514 for coupling the cap 514 with the receiver 570. The opening 604 can be further defined by a receiving face 598, which can be angled with respect to an upper edge of the locking sleeve 596 in the direction of the opening 604, and a locking shoulder 600.

Figure 15B:
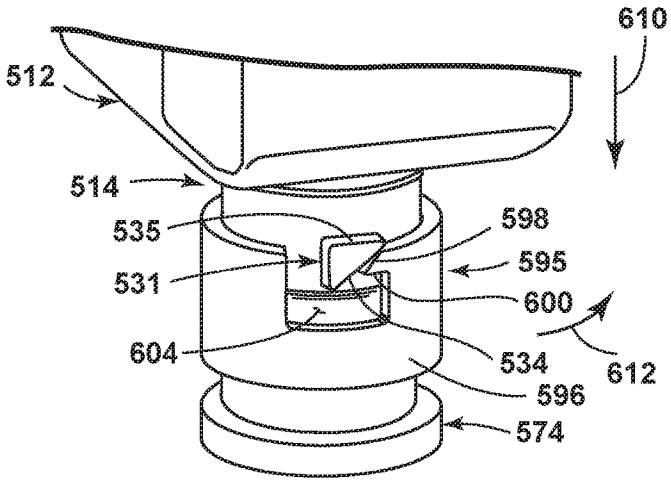
FIGS. 15A-D illustrate a process of coupling a container and cap assembly with a receiver of a surface cleaning device according to various aspects described herein.
Figure 15A:
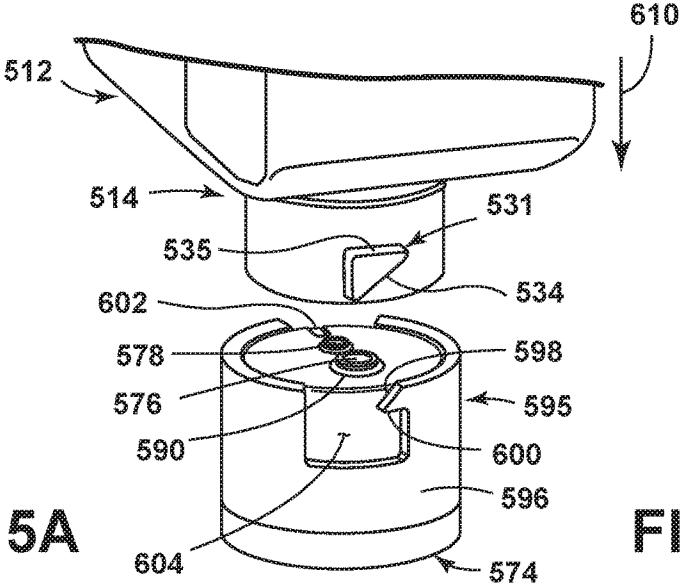
Figure 15D:
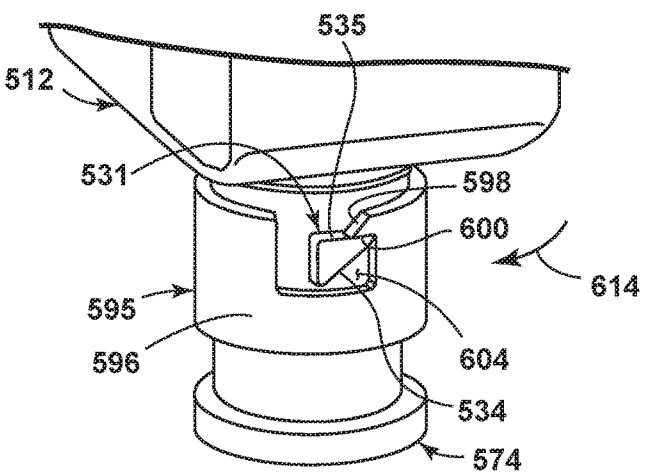
Figure 15C:
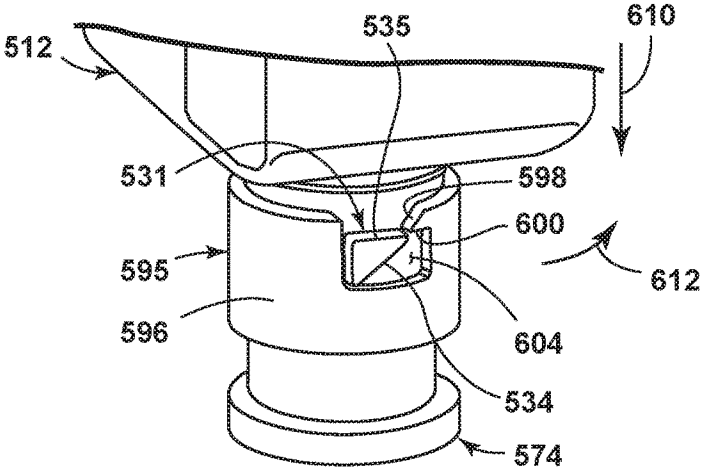

FIGS. 15A-15D illustrate the manner in which the container and cap assembly 510 can be coupled with the receiver 570. FIG. 15A illustrates the receiver 570 in which the receiving element 574 and locking sleeve 596 of the locking mechanism 595 are in an uncoupled state. The container 512 can be moved toward the receiver 570 in an inverted state, as illustrated by arrow 610, to bring the cap 514 into contact with the receiving element 574. As illustrated in FIGS. 15B and 15C, as the container 512 is moved towards and pressed against the receiving element 574, the receiving element 574 moves relative to the sleeve 596 against the bias of the biasing element 594, in the direction illustrated by arrow 610. The container 512 can be positioned relative to the sleeve 596 such that the camming surface 534 of the retaining element 531 contacts the receiving face 598 of the locking sleeve 596. The camming surface 534 and receiving face 598 are angled such that continued downward movement of the container 512 in the direction of arrow 610 causes the sleeve 596 to rotate relative to the receiving element 574, against the bias, in the direction of arrow 612 to receive the retaining element 531 within the opening 604. As the retaining element 531 moves past the receiving face 598 and is received within the opening 604 (FIG. 15C), the sleeve 596 rotates relative to the receiving element 574 in the direction of arrow 614 due to the bias of the locking sleeve 596, as illustrated in FIG. 15D, and the locking shoulder 600 abuts the underside 535 of the retaining element 531.

Figure 16:
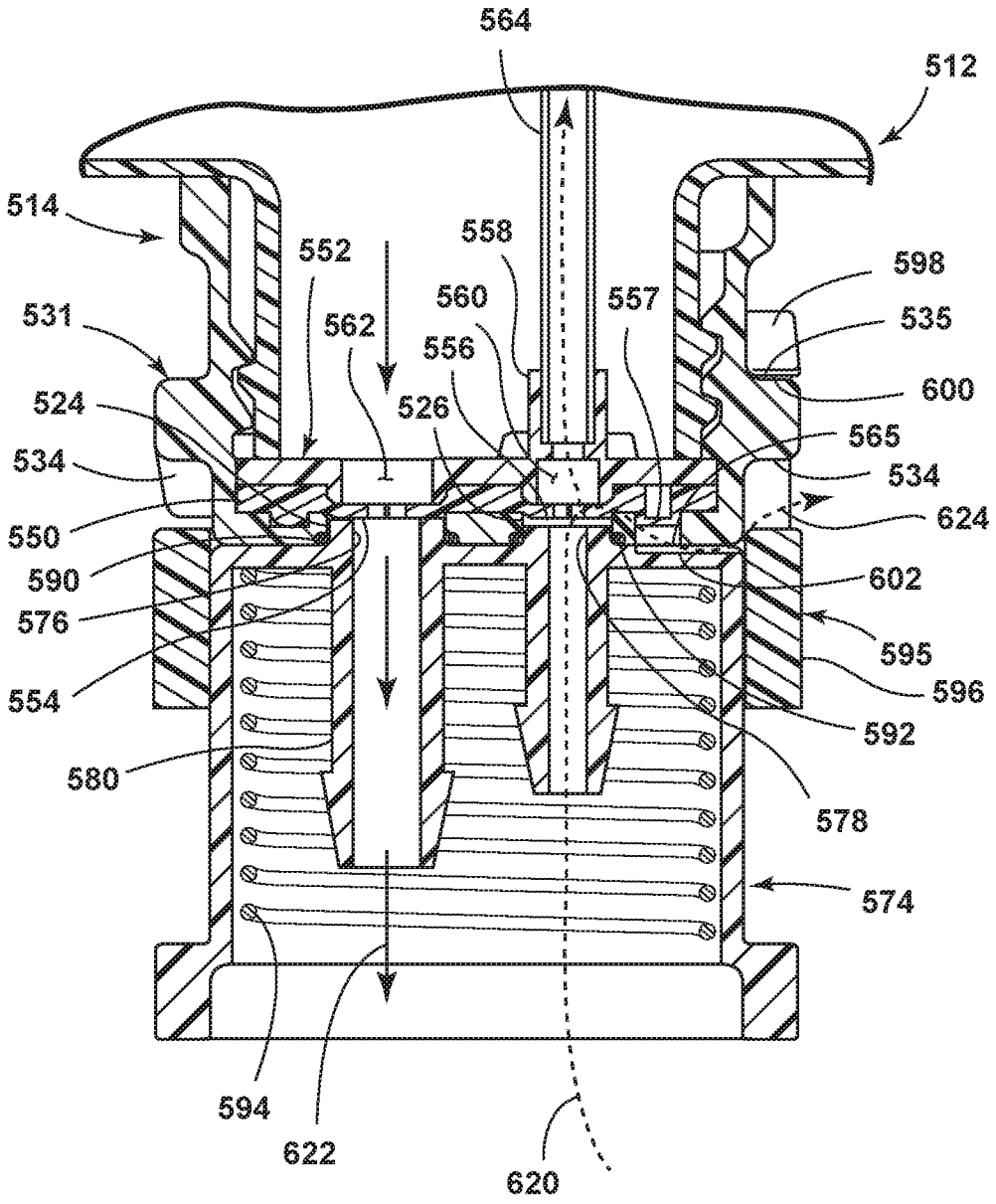
FIG. 16 is a cross-sectional view of a container and cap assembly coupled with a receiver of a surface cleaning device according to various aspects described herein.

Referring now to FIG. 16, the locking shoulder 600 of the locking mechanism 595 is configured to engage the underside 535 of the retaining element 531 such that the end face 528 of the cap 514 is retained against the receiving element 574 against the bias of the biasing element 594. The opposing forces of the locking mechanism 595 and the biasing element 594 provide a sealing force that provides a fluid tight seal between the cap 514 and the receiving element 574 to minimize leakage during use and coupling/uncoupling of the container and cap assembly 510 with the receiver 570 and to facilitate dispensing of the treating chemistry. The first and second O-rings 590, 592 also contribute to forming a fluid tight seal between the cap 514 and the receiving element 574.

While the locking mechanism 595 is described in the context of a biased locking sleeve 596, it is also within the scope of the present disclosure for the locking sleeve 596 to not be biased. When the locking sleeve 596 is not biased, the locking sleeve 596 can be rotated manually by a user to engage the locking shoulder 600 of the sleeve 596 with the underside 535 of the retaining element 531 to retain the cap 514 against the receiving element 574 against the bias of the receiving element 574.

To disengage the container and cap assembly 510 from the receiver 570, the locking sleeve 596 can be rotated relative to the receiving element 574, in the direction of arrow 612, to disengage the locking shoulder 600 from the retaining element 531 such that the retaining element 531 can be withdrawn from the opening 604 as the container 512 is withdrawn.

Still referring to FIG. 16, when the cap 514 is coupled with the receiver 570, the liquid outlet 524 and the air inlet 526 of the cap 514 are fluidly coupled with the liquid inlet 576 and the air outlet 578, respectively, of the receiving element 574, such that air can be pumped into the container 512 and liquid stored within the container 512 can be dispensed from the container 512. As illustrated by arrows 620, air can be pumped into the receiver 570 through the air connector portion 584, which can be connected with a supply of air, such as described above with respect to the surface cleaning devices 132 and 232 of FIGS. 7 and 8, respectively. The air 620 flows through the air connector portion 584 and enters the cap 514 through the air inlet 526.

At a predetermined pressure, the air inlet valve 556 in the cap 514 opens and allows the air 620 to enter the air channel 560 in the second seal 552 which is fluidly connected with the air tube 564 through the air tube outlet 558. The air 620 flows through the air tube 564 into the cavity 522 of the container 512, pressurizing the contents of the container 512. At a predetermined pressure, the liquid outlet valve 554 in the cap 514 opens, allowing the contents of the container 512 to flow out of the container 512 to the liquid connector portion 580 of the receiver 570 through the liquid outlet 524 in the cap 514 and the liquid inlet 576 of the receiving element 574, as illustrated by arrows 622.

The air inlet valve 556 is configured as a one-way seal such that the seal will close when the pressure from the air flow drops below a predetermined pressure to minimize leakage of fluid from the container 512 through the air inlet valve 556. Similarly, the liquid outlet valve 554 is configured as a one-way seal that opens when the pressure inside the container 512 reaches a predetermined pressure to allow liquid to flow out of the container 512 and closes when the pressure drops below the predetermined pressure to minimize leakage.

Still referring to FIG. 16, the cap 514 can include a controlled air leak which can be used to regulate the pressure in the container and set the flow rate of the liquid out of the container 512. As the air 620 flows through the air inlet 526 to the air inlet valve 556, the first seal 550 can be configured to allow a predetermined amount of air to leak or escape the cap 514 through the air leak valve 557 and air leak apertures 565. The receiving element 574 can be provided with a complementary air leak groove 602 aligned with the air leak apertures 565 to allow the air to escape the receiver 570. The amount of air that leaks through the air leak valve 557 and air leak apertures 565 can be used to control the amount of air supplied into the container 512 and thus control the pressurization within the container 512. In this manner, a single pump can be used to dispense a treating chemistry at multiple different flow rates depending on the configuration of the container and cap assembly 510.

For example, some treating chemistries may be more desirably dispensed from the container 512 at a predetermined flow rate based on the treating chemistry and/or the intended use of the treating chemistry. Variable speed pumps can be more costly than single or multi-speed pumps and thus it is typically more cost effective to use a single or multi-speed pump with a surface cleaning device. In addition, different surface cleaning device models may have pumps operating at different speeds. The air leak from the cap 514 can be configured to control the flow rate of treating chemistry from the container 512 based on the treating chemistry, independently of the pump provided on the surface cleaning device or devices intended for use with the container and cap assembly 510, as long as the pump provides a predetermined minimum air flow rate. In this manner, the flow rate of treating chemistry from a given container 512 can be controlled at a predetermined rate across a variety of pumps and surface cleaning device models. In addition, using an air leak in the cap 514 to control the flow rate of chemistry rather than relying on the air pump can provide flexibility and cost savings in pump selection and design for the surface cleaning device.

While the air leak valve 557 and air leak apertures 565 are described in the context of the cap 514, it will be understood that the cap 514 can also be configured without the air leak valve 557 and air leak apertures 565, in which case the receiving element 574 could also be configured without the air leak groove 602. It is also within the scope of the present disclosure for the air leak valve 557 and air leak apertures 565 to be provided on the cap 14 of FIGS. 1 and 2 to control the flow rate of treating chemistry from the container 12 in a manner similar to that described above for the container 512. The receiving element 74 of FIGS. 3 and 4 can also be provided with the air leak groove 602 in the same manner as described above for the receiving element 574 for use with a cap 14 including an air leak.

The container and cap assembly 510 and receiver 570 can also be used with the surface cleaning devices 132 and 232 of FIGS. 7 and 8, respectively, to dispense a treating chemistry to a surface being cleaned in a manner similar to that described above for the container and cap assembly 10 and receiver 70, by replacing the receiver 70 with the receiver 570.

In addition, the cap 514 can be configured to separate into first and second portions in a manner similar to that described above with respect to the cap 314 of FIGS. 9 and 10 to facilitate use of the container and cap assembly 514 with surface cleaning devices having different receivers in a manner similar to that described above for the cap 314.

The container and cap assemblies described herein allow for a liquid to be selectively dispensed under pressure from a container to a fluid delivery system of a surface cleaning device to a surface being cleaned. The cap is configured to both allow air to flow into the container and liquid to flow out of the container with minimal leakage of liquid from the container. The cap can also be configured to couple with a receiver on the surface cleaning device to form a fluid tight seal to minimize the leakage of liquid from the container and within the receiver of the surface cleaning device. The fluid tight seal also allows sufficient pressure to build up within the container to dispense liquid from the container. In addition, the incorporation of an air leak into the cap can be used to control the flow rate of treating chemistry from the container independently of the pump provided on the surface cleaning device, which can facilitate the use of a single container across multiple surface cleaning devices and provide cost savings with regards to pump design.

To the extent not already described, the different features and structures of the various examples may be used in combination with each other as desired. For example, any of the container and cap assemblies 10, 310, and 510, receivers 70 and 570, fluid delivery systems 130 and 230, and surface cleaning devices 132 and 232 may be combined in whole or in part with one another, even if not expressly described. That one feature may not be illustrated in all of the examples is not meant to be construed that it cannot be, but is done for brevity of description. Thus, the various features of the different examples may be mixed and matched as desired to form new examples, whether or not the new examples are expressly disclosed.

While the present disclosure has been specifically described in connection with certain specific examples thereof, it is to be understood that this is by way of illustration and not of limitation. Reasonable variation and modification are possible within the scope of the forgoing disclosure and drawings without departing from the spirit of the present disclosure which is defined in the appended claims.

What is claimed is:

1. A container and cap assembly, comprising:

a container having a top wall in which an opening is formed, a bottom wall, and at least one container side wall extending between the top wall and the bottom wall defining a cavity for storing a material; and a cap received on the container to close the opening and further comprising:

an end face having at least one fluid outlet and at least one fluid inlet; and a side wall extending from the end face;

wherein the cap is separable along the side wall to separate a first portion of the cap including the end face from a second portion of the cap which is received on the container, the second portion remaining on the container after separation of the first portion.

2. The container and cap assembly of claim 1 wherein the first portion of the cap includes a retaining element extending from at least a portion of the side wall and having an angled camming surface.

3. The container and cap assembly of claim 2 wherein the retaining element comprises a shoulder extending outwardly from the side wall at an angle with respect to a longitudinal axis extending through the end face, with an outer surface of the shoulder forming the angled camming surface.

4. The container and cap assembly of claim 2 wherein the retaining element comprises at least two bosses protruding from the side wall, each boss having an outer surface forming the angled camming surface, wherein the angled camming surface is formed at an angle with respect to a lateral axis extending through the side wall, parallel to the end face.

5. The container and cap assembly of claim 1 wherein the first portion of the cap includes a first retaining element and the second portion of the cap includes a second retaining element, different than the first.

6. The container and cap assembly of claim 1 wherein air flows through the at least one fluid inlet and through the opening of the container into the cavity to pressurize the cavity to displace at least a portion of the material through the opening of the container and the at least one fluid outlet to dispense the material stored within the container.

7. The container and cap assembly of claim 6, further comprising an air leak in the cap to control the flow of air through the at least one fluid inlet and control dispensing of the material through the at least one fluid outlet.

8. The container and cap assembly of claim 1, further comprising at least one line of weakness in the side wall, wherein the first portion is separable from the second portion along the at least one line of weakness.

9. The container and cap assembly of claim 1, further comprising a removable section of the side wall between the first portion and the second portion, wherein the removable section is removed from the side wall to separate the first portion and the second portion.

10. The container and cap assembly of claim 9 wherein the removable section includes a tab configured to be grasped by a user to remove the removable section of the side wall.

11. The container and cap assembly of claim 1 wherein the container is configured to couple with a receiver of a surface cleaning apparatus.

12. A fluid delivery system, comprising:

a container having a top wall in which an opening is formed, a bottom wall, and at least one container side wall extending between the top wall and the bottom wall defining a cavity for storing a material;

a surface cleaning apparatus comprising a receiver configured to couple with the container, the receiver comprising at least one receiver fluid inlet, at least one receiver fluid outlet and a locking mechanism; and a cap received on the container to close the opening, the cap comprising:

an end face having at least one fluid outlet and at least one fluid inlet; and a side wall extending from the end face;

wherein the cap is separable along the side wall to separate a first portion of the cap including the end face from a second portion of the cap which is received on the container, the second portion remaining on the container after separation of the first portion.

13. The fluid delivery system of claim 12 wherein the first portion of the cap includes a retaining element extending from at least a portion of the side wall and having an angled camming surface.

14. The fluid delivery system of claim 13 wherein the retaining element comprises a shoulder extending outwardly from the side wall at an angle with respect to a longitudinal axis extending through the end face, with an outer surface of the shoulder forming the angled camming surface.

15. The fluid delivery system of claim 13 wherein the retaining element comprises at least two bosses protruding from the side wall, each boss having an outer surface forming the angled camming surface, wherein the angled camming surface is formed at an angle with respect to a lateral axis extending through the side wall, parallel to the end face.

16. The fluid delivery system of claim 12 wherein the first portion of the cap includes a first retaining element and the second portion of the cap includes a second retaining element, different than the first.

17. The fluid delivery system of claim 12 wherein air flows through the at least one fluid inlet and through the opening of the container into the cavity to pressurize the cavity to displace at least a portion of the material through the opening of the container and the at least one fluid outlet to dispense the material stored within the container.

18. The fluid delivery system of claim 12, further comprising at least one line of weakness in the side wall, wherein the first portion is separable from the second portion along the at least one line of weakness.

19. The fluid delivery system of claim 12, further comprising a removable section of the side wall between the first portion and the second portion, wherein the removable section is removed from the side wall to separate the first portion and the second portion.

20. The fluid delivery system of claim 12 wherein the surface cleaning apparatus comprises at least one of a vacuum cleaner, an extraction cleaner, a bare floor cleaner, a mop or a steam mop.

* * * * *